US005596394A

United States Patent [19]

Nishiguchi et al.

[11] Patent Number: 5,596,394

[45] Date of Patent: Jan. 21, 1997

[54] CHARGING APPARATUS FOR CHARGING A PHOTO-SENSITIVE MEMBER BY MAGNETICALLY HOLDING MAGNETIC PARTICLES IN A CHARGING ZONE

[75] Inventors: Yasuo Nishiguchi; Susumu Kikuchi; Ryushi Imoo; Sigeki Tsukahara; Shinji Yamane, all of Tokyo, Japan

[73] Assignee: Kyocera Corporation, Kyoto, Japan

[21] Appl. No.: 245,281

[22] Filed: May 18, 1994

[30] Foreign Application Priority Data

| | | | |
|---|---|---|---|
| May 20, 1993 | [JP] | Japan | 5-139831 |
| Aug. 25, 1993 | [JP] | Japan | 5-232308 |
| Aug. 31, 1993 | [JP] | Japan | 5-238839 |
| Aug. 31, 1993 | [JP] | Japan | 5-238840 |
| Aug. 31, 1993 | [JP] | Japan | 5-239040 |
| Dec. 28, 1993 | [JP] | Japan | 5-353326 |

[51] Int. Cl.[6] ..... G03G 15/01

[52] U.S. Cl. ..... 399/175; 361/225

[58] Field of Search ..... 355/219, 246, 355/210, 211, 213; 361/225, 221, 230

[56] References Cited

U.S. PATENT DOCUMENTS

| | | | |
|---|---|---|---|
| 3,804,511 | 4/1974 | Rait et al. | 355/17 |
| 4,935,114 | 7/1983 | Ura et al. | 355/210 |
| 5,298,949 | 3/1994 | Yamamote et al. | 355/246 |
| 5,357,323 | 10/1994 | Haneda et al. | 355/219 |
| 5,406,353 | 4/1995 | Asanae | 355/200 |

*Primary Examiner*—Thu A. Dang
*Attorney, Agent, or Firm*—Loeb & Loeb LLP

[57] ABSTRACT

A particle charging apparatus for charging a photo-sensitive drum by magnetically holding magnetic particles in a charging zone and impressing a charging bias on the magnetic particles. Adjacent to an opposed pole which is disposed on the back side of the photo-sensitive drum on the charging zone upstream side for forming a vertical magnetic field, an opposite polarity magnet or magnetic member is disposed such that a mainly horizontal magnetic field is formed on the drum by the opposed and adjacent poles. A vertical magnetic field is formed on the charging zone downstream side by a main pole and the opposed pole. A non-magnetic sleeve with the main pole therein is rotated in the direction opposite that of the drum, thus causing magnetic particles in the vertical magnetic field to be circulated toward the charging zone upstream side. Leakage and spattering of magnetic particles out of the charging zone is effectively prevented by simple construction, and stable charging is permitted even with a reduced photo-sensitive drum size or with assembling errors of a charging sleeve or the like.

44 Claims, 16 Drawing Sheets

CHARGING APPARATUS FOR CHARGING A PHOTO-SENSITIVE MEMBER BY MAGNETICALLY HOLDING MAGNETIC PARTICLES IN A CHARGING ZONE

BACKGROUND OF THE INVENTION

1. Field of the Invention

This invention relates to a method of and an apparatus for charging, which are applicable to electrophotographic systems, such as copiers, printers, facsimile apparatuses, etc. and, more particularly, to a charging apparatus used for an electrophotographic system, in which a photo-sensitive medium in the form of a belt or a drum is charged by charges on particles.

2. Description of the Prior Art

An electrophotographic system which is based on a commonly called Carlson process, is well known in the art. In this process, various process means for exposure, development, transfer, cleaning (i.e., residual toner removal), discharging and charging are disposed around a photo-sensitive drum for image formation by a predetermined electrophotogrpahic process.

Also, recently a non-Carlson process image formation system is well known in the art (as disclosed in Tokkai Sho 58-153957 issued by Japanese Patent Office, etc.). This system comprises a photo-sensitive drum, which includes a cylindrical transparent support, on which a transparent conductive layer and a photo-conductive layer are laminated. An exposure means (e.g., a LED head) which generates an optical output corresponding to image information is provided in the photo-sensitive drum. The drum is charged by a charging means, and then it is exposed to an optical output of the exposure means via a converging lens. Simultaneously or immediately afterwards, the latent image thus formed on the photo-sensitive drum is developed to a toner image by a development sleeve which faces the drum, the toner image thus produced being capable of being transferred to a recording sheet by a transfer roller or other transfer means.

There are various charging means that may be used for this type of image formation system. Among such charging means are one of corotoron system, in which a high voltage is applied to a thin tungsten wire for corona discharge, one, in which a voltage of several hundres volts is applied to a conductive roller for contact charging of the photo-sensitive drum, one, in which a voltage is applied to a conductive brush for contact charging of the drum, etc.

The corotoron system charging means, however, uses high voltage or generates ozone, and it poses many problems concerning the safety and environments.

In the charging roller system, the charging roller is in line contract with the photo-sensitive drum, and therefore the charging is in stable.

In the case of the conductive brush type charging means, the brush is held in contact with the drum for the charging thereof, and therefor the brush is deteriorated as it is used in charging the drum.

To obviate the above drawbacks, a commonly called particle charging process has been proposed (as disclosed in Tokkai Sho 59-133569 and Tokkai Sho 63-187267 both issued by Japanese Patent Office). As shown in FIG. 21, this process uses a non-magnetic sleeve 103, which faces a photo-sensitive drum 101 and accommodates a magnet assembly 102. A charging bias voltage source 108 is connected to the sleeve 103 or to a conductive blade 107 to let magnetic particles 104 be attached to the sleeve 103 such as to form a magnetic brush. The photo-sensitive drum 101 is rotated with the magnetic brush in contact with it while applying a charging bias 108 to the magnetic particles 104 via the sleeve or the like, thus causing the charging of the drum.

In this particle charging process, since the photo-sensitive drum 101 is charged via the magnetic particles 104, the area and density of the contact between the magnetic particles 104 and the photo-sensitive drum 101 in the charging area thereof have to sufficiently meet proposed requirements. The contact area of the magnetic brush is determined by the outer diameters of the photo-sensitive drum 101 and the non-magnetic sleeve 103 accommodating the magnet assembly 102. This means that the width of the contact is reduced with reducing sizes of the photo-sensitive drum 101 and the sleeve 103. In addition, the linear speed of the photo-sensitive drum is increased for increasing the number of prints produced per unit time, the rotational speed of the drum is also increased. Therefore, the contact width may become unstable.

In order to ensure stable contact width, the permissible gap between the photo-sensitive drum 101 and the non-magnetic sleeve 103 has to be set stringently. Setting such a condition, however, dictates an increased number of assembling steps and hence to a cost increase. Besides, assembling errors due to the excentricity between the magnet assembly 102, which is held stationary, and the non-magnetic sleeve 103, and further to thermal and other environmental expansion and contraction, cause variations of the magnetic force and magnetic force line density, thus disabling stable charging.

In a further aspect, there is a problem that magnetic particles are attached to the photo-sensitive drum.

In many cases of the charging process described above, the magnetic brush is formed by the magnet assembly 102 held stationary in order to obtain a stablilized charging area and prevent the spattering of toner particles. In such cases, the magnetic field is attenuated in proportion to the square of the distance from a magnetic pole **102*a* of the magnet assembly 102**. Thus, the magnetic particles which are on the surface of the photo-sensitive drum are subjected to the weakest magnetic coercive force.

With the rotation of the photo-sensitive drum 101 in this state, centrifugal forces are exerted to the drum surface, and the magnetic particles 104 that are held electrostatically attached to the drum surface 101, exerience forces acting in the direction of the magnetic brush, i.e., the direction away from the charging area, which is opposite to the direction of the magnetic coercive force (i.e., magnetic field) applied from the stationary magnet assembly 102. This means that the magnetic particles 104 held attached to the drum surface have adverse effects on the subsequent exposure, development, etc..

Accordingly, in the prior art, as shown in FIG. 22, for recovering magnetic particles a blade 105 is provided downstream the charging area in the direction of movement of the photo-sensitive drum. This arrangement, however dictates a mechanism for recovering the magnetic particles **104*a* attached to the blade 105** to permit long use of the apparatus, thus complicating the construction.

SUMMARY OF THE INVENTION

Purpose

The invention has an object of providing a charging apparatus, which permits a uniform magnetic field to be set up at all times without being adversely affected by variations of the charging gap between the photo-sensitive medium and the development sleeve and also by assembling errors, etc. and can also prevent magnetic particles from being held attached to and held on the photo-sensitive drum.

Another object of the invention is to provide a charging apparatus, which permits effective and sufficient charging of the photo-sensitive drum to be obtained even with a reduced photo-sensitive drum size or with a reduced charging bias voltage.

A further object of the invention is to provide a charging apparatus, which, with a simple construction, can effectively prevent magnetic particles from getting or being spattered out of the charging area with a simple construction and permits stable charging even with a reduced photo-sensitive drum size or irrespective of errors in the assembling of the charging sleeve, etc..

A still further object of the invention is to provide a charging apparatus, which can ensure stable charging performance for long time.

A yet further object of the invention is to provide a charging apparatus, which, with a simple construction, can effectively prevent magnetic particles from getting and being spattered out to the outside downstream the charging area in the direction of movement of the photo-sensitive drum.

A further object of the invention is to provide a charging apparatus, which can effectively prevent the attachment of magnetic particles to the photo-sensitive drum at the axial ends thereof.

A further object of the invention is to provide a charging apparatus, which can ensure stable charging performance without deterioration of charging agent despite charging operation for long time.

Constitution

To attain the above objects of the invention, there is provided a commonly called particle charging apparatus for charging a photo-sensitive drum with magnetic particles, which are magnetically held on the photo-sensitive drum in a charging area thereof by a charging bias applied to them, in which apparatus, as shown in FIG. 1, magnetic field generation means $A_1$ and $B_1$ comprising magnetic members or magnets are provided on the front and back sides, respectively, of a photo-sensitive drum 1 in a charging area thereof such that they substantially face each other and form a vertical magnetic field 4A to the photo-sensitive drum 1, the vertical magnetic field 4A serving to hold magnetic particles 4 in the charging area so as to effect charging of the photo-sensitive drum 1.

In this case, vertical magnetic field formation means is suitably formed with a magnet (main pole $A_1$) and an opposite polarity magnet (opposite pole $B_1$). However, it is possible to form the magnet $A_1$ (main pole $A_1$) and the opposite pole $B_1$ with a magnetic metal $B_1'$, such as iron or ferrite. Conversely, it is possible to form the main pole $A_1$ with a magnetic member and the opposite pole $B_1$ with a magnet.

The magnetic particles 4 generally are suitably conductive magnetic particles or blend particles consisting of conductive magnetic particles and insulating magnetic particles. A charging bias source 8 is connected via the non-magnetic conductive sleeve 3 or a conductive blade (not shown) while grounding the photo-sensitive drum 1, thus permitting a charging bias to be impressed on the surface of the photo-sensitive drum 1 via the magnetic particles 4.

The main pole $A_1$ may be provided such that it directly faces the photo-sensitive drum 1. Alternatively, it may be accommodated in a conductive non-magnetic sleeve 3 (hereinafter referred to as non-magnetic sleeve). As a further alternative, it may be coated with an electrode film connected to the charging bias source 8.

According to the invention as such, the magnet for magnetically holding magnetic particles is provided not only on one side of the development gap but on each side thereof. It is thus possible to set a substantially uniform magnetizing force $\Delta H/\Delta t$ (H: intensity of the magnetic field, t: distance) in the charging gap. Consequently, it is possible to maintain a stable magnetic force for holding the magnetic particles 4 irrespective of a slight assembling error of the charging gap or with a great gap tolerance or without need of taking the excentricity between the photo-sensitive drum 1 and the non-magnetic sleeve 3 into considerations.

Further, the possibility of coarsely setting the assembling tolerance, excentricity, etc. leads to the reduction of the number of assembling steps and the cost of manufacture.

Further, with the main and opposite poles $A_1$ and $B_1$ disposed on the opposite sides of the charging gap, the vertical magnetic field 4A is formed in the normal direction to the photo-sensitive drum 1. Besides, the opposite pole $B_1$ disposed on the back side of the drum 1 permits a certain degree of mangetic coercive force to be obtained on the drum surface.

Thus, with the main and opposite poles $A_1$ and $B_1$ facing each other downstream the charging area in the direction of movement of the photo-sensitive drum 1 as shown in FIG. 2, a commonly called perpendicular magnetic barrier is formed downstream the charging area, thus preventing the magnetic particles having been electrostatically attached to the photo-sensitive drum 1 from getting out of the charging area due to the action of centrifugal forces.

However, even according to the invention as shown in FIG. 1, the charging area is restricted by the width of the magnets. Besides, since the vertical magnetic field 4A is constituted by magnetic lines of force formed between the magnets, the magnetic particles 4 are directed in the normal direction to the photo-sensitive drum 1. This leads to a reduced magnetic particle density. Further, the charging area is the narrower the smaller the diameters of the photo-sensitive drum 1 and the non-magnetic sleeve 3 in this state. Ultimately, it becomes impossible to obtain smooth charging.

Accordingly, according to the invention, as sown in FIGS. 2 to 6, upstream the charging area on the back surface side of the photo-sensitive drum 1 and adjacent the opposite pole $B_l$ (or $B_1'$) forming the vertical magnetic field 4A, a magnet or a magnetic member (adjacent pole $B_2$) is disposed, which has the opposite polarity to the opposite pole $B_1$ (or $B_1'$), thus forming a mainly horizontal magnetic field 4B on the photo-sensitive drum 1 with the opposite pole $B_1$ (or $B_1'$) and the adjacent pole $B_2$.

The horizontal magnetic field 4B that is formed between the opposed and adjacent poles $B_1$ (or $B_1'$) and $B_2$ permits the magnetic particles 4 to be in close contact with the photo-sensitive drum 1 over a broader area.

It is thus possible to ensure the necessary charging contact area, which the magnetic particles 4 are in contact with, as well as the charging density effectively even with a reduced diameter of the photo-sensitive drum 1.

Meanwhile, with the above construction the magnetic coercive force experienced by the magnetic particles is greatly increased compared to that in the prior art. This means that magnetic particles 4 in the charging area are incapable of replacement. That is, it is liable that the same magnetic particles 4 are held for long time and deteriorated.

According to the invention, as shown in FIGS. 2 to 5, the non-magnetic sleeve 3 is rotated in the direction opposite to the direction of rotation of the photo-sensitive drum 1, thus causing the magnetic particles 4 retained on the vertical magnetic field 4A to be circulated toward a zone upstream the charging area as shown at 4C.

The circulation may be made smoother by providing a higher magnetic force on the sleeve surface at the position of formation of the vertical magnetic field 4A than the magnetic force on the surface of the photo-sensitive drum 1.

This arrangement can eliminate the possibility of deterioration of the magnetic particles to eliminate charging performance deterioration despite long time of the use for the charging operation.

Preferably, as shown in FIGS. 3 to 6, means $A_3$, 9, 11 for circulating or stirring the magnetic particles 4 is disposed upstream the area of formation of the vertical magnetic field 4A in the direction of movement of the photo-sensitive drum 1. In this case, the magnetic particles 4 which are magnetically sealed by the vertical magnetic field 4A can be more smoothly circulated or stirred in the charging area.

As for means for causing the circulation noted above, for instance as shown in FIGS. 3 to 5, an area substantially free from magnetic force may be formed on the non-magnetic sleeve 3 upstream the charging area by a pole $A_3$ provided in the stationary magnet assembly in the non-magnetic sleeve 3. This area substantially free from magnetic force serves as magnetic releasing means for releasing the magnetic restriction on the magnetic particles 4 carried on the non-magnetic sleeve 3 so that the released magnetic particles fall onto the photo-sensitive drum 1. Alternatively, as shown in FIG. 5, mechanically separating means 9 such as a film or a blade may be used to mechanically separate the magnetic particles 4 carried on the non-magnetic sleeve 3 on the upstream side of the charging area.

The area substantially free from magnetic force may be formed by providing the pole $A_3$, which provides only as low magnetic force as about 50 Gauss or below, upstream the charging area on the downstream side of the main pole $A_1$ in the direction of rotation of the non-magnetic sleeve 3. Alternatively, a repelling magnetic field may be formed with the pole $A_3$ of the same polarity as the main pole $A_1$ such as to provide as low magnetic force as about 50 Gauss or below on the upstream side of the charging area.

The circulation of the magnetic particles 4 is obtainable without use of the non-magnetic sleeve 3. For example, as shown in FIG. 6, the particles 4 may be mechanically stirred for their interchange by providing magnetic particle stirring means 11 in a charging zone upstream the area of formation of the vertical magnetic field 4A.

As a further alternative, the main, opposed and adjacent poles $A_1$, $B_1$ and $B_2$ may be formed with electromagnets to permit suitable polarity conversion or impressed voltage change during non-printing or for every predetermined number of prints by utilizing a DC power supply voltage varying means or the like or cause swinging of the individual poles by a predetermined angle, thus effecting the interchange of the particles 4.

According to the invention, the main and opposed poles $A_1$ and $B_1$ effect magnetic sealing to prevent leakage of magnetic particles from the charging zone. However, it is considerably difficult to permit the charging and the magnetic sealing at the same locality.

Accordingly, as a preferred form of the invention, as shown in FIGS. 3, 4, 5, 7A and 7B, a magnet (i.e., a shield pole) $A_2$ or $B_3$ which is of the same polarity as the opposed pole $B_1$ disposed on the back side of the photo-sensitive drum 1, is disposed on the back or front side of the photo-sensitive drum 1 in a downstream area thereof in the direction of movement. In this case, a repelling magnetic field formed between the shield pole and the opposed pole $B_1$ is utilized to magnetically shield the magnetic particles 4 at the end of the charging area.

Specifically, as shown in FIG. 15, the shield pole $B_3$ may be disposed on the back side of the photo-sensitive drum 1 such that it is adjacent to the opposed pole $B_1$. Alternatively, as shown in FIGS. 3, 4, 5, 7A and 7B, the shield pole $A_2$ may be disposed in the non-magnetic sleeve 3 such that it substantially faces the opposed pole $B_1$ on the opposite side of the photo-sensitive drum 1 and that it extends on the front side of the photo-sensitive drum 1 (see FIGS. 7A and 7B) and in a direction at right angles to the direction of movement of the photo-sensitive drum 1.

In this case, the magnetic force line densities of the main, opposed and shield poles $A_1$, $B_1$ and $A_2$ are suitably set as follows.

$S_2>S_1$, $S_2<N_1$ and $N_1>S_1$, where $N_1$: magnetic force line density of the main pole $A_1$ on the non-magnetic sleeve 3, $S_1$: magnetic force line density of the opposed pole $B_1$ on the photo-sensitive drum 1, and $S_2$: magnetic force line density of the shield pole $A_2$.

With the above setting of the magnetic force line densities, the magnetic force line density differences cause the magnetic particles, which are on the surface of the photo-sensitive drum 1 and prevented from leaking to the outside of the charging zone, to be directed toward the main pole $A_1$, i.e., toward the non-magnetic sleeve 3. Thus, it is possible to obtain circulation of the magnetic particles within the charging zone. That is, with the above construction, a repelling magnetic field set up by like polarity poles ($B_1$ and $B_3$ or $B_1$ and $A_2$) can form a magnetic-force-free zone at the downstream end of the charging zone on the photo-sensitive drum 1. The magnetic-force-free zone can prevent leakage of magnetic particles toward the photo-sensitive drum and retain the magnetic particles in the charging zone. It is thus possible to effectively prevent leakage of the magnetic particles from the charging zone without use of any blade or the like as mechanical separation means.

In this case, for readier circulation of the magnetic particles 4 in the charging zone toward the upstream side the non-magnetic sleeve 3 may be constructed such that it can be rotated in the direction opposite to the direction of movement of the photo-sensitive drum 3.

Instead of forming or in combination with the above repelling magnetic field, as shown in FIG. 17, further effective prevention of magnetic particle leakage is obtainable by disposing a magnetic member $A_4$ adjacent the opposed or main pole $B_1$ or $A_1$ and downstream the charging zone such as to form a closed circuit of vertical magnetic field between the main pole $A_1$ and the magnetic member $A_4$.

As described before, the vertical magnetic field 4A downstream the charging zone is used mainly for sealing or circulating magneticity, and it is possible to obtain sufficient charging with the sole horizontal magnetic field 4B.

Further, it is possible, as shown in FIG. 15, to dispose two magnets of different polarities or two magnetic field generating means comprising combinations of magnets and magnetic members, i.e., the opposed and adjacent poles $B_1$ and $B_2$, adjacent to each other to obtain the charging while the magnetic particles 4 are held in close contact with the photo-sensitive drum 1 by the horizontal magnetic field 4B set up mainly between the poles $B_1$ and $B_2$.

Again in this case, it is suitable to dispose the shield pole $B_3$ at a position adjacent to the opposed pole $B_1$ and slightly beyond the downstream end of the charging zone on the back side of the photo-sensitive drum 1.

Further, in this case it is possible to obtain magnetic circulation by constructing the poles $B_1$ and $B_2$ for swinging by a predetermined angle by a shaft 1A.

In a further preferred form of the invention, a conductive electrode is disposed in the magnetically sealed charging zone, whereby further stable charging can be ensured.

For example, as shown in FIG. 4, it is suitable to dispose a conductive electrode 7 in an upstream part of the charging zone, which is formed by the magnetic particles 4 carried on the photo-sensitive drum 1 with the magnetic force of the main pole $A_1$, in the direction of movement of the photo-sensitive drum 1 such that it faces the drum 1.

In this case, the conductive electrode 7 is suitably disposed in the charging zone 4B of the horizontal magnetic field upstream the zone of formation of the vertical magnetic field 4A such that it faces the photo-sensitive drum 1.

The electrode 7 may be connected to a common or independent charging bias source 8, or it may be constructed as a floating electrode.

Where the electrode 7 is connected to the charging bias source 8, it is suitable to permit the charging bias to be impressed on the photo-sensitive drum 1 from the electrode 7 or from the non-magnetic sleeve 3 and the electrode 7 via the magnetic particles 4.

Where the electrode 7 is a floating electrode not connected to the charging bias source 8, it is suitable to permit the floating electrode to receive the charging bias impressed on the magnetic particles 4 via the non-magnetic sleeve 3 or other bias supply member.

According to the invention such as above, the main and opposed poles $A_1$ and $B_1$ may be disposed in a downstream part of the charging zone which is best suited for the magnetic sealing, while disposing the conductive electrode 7 in an upstream part as the best position for the charging. It is thus possible to provide a structure which substantially provides for the magnetic sealing and charging as separate functions.

In this case, with the main pole $A_1$ enclosed in the non-magnetic sleeve 3, it is possible to form satisfactory image free from a ghost by connecting the charging bias source 8 to the non-magnetic sleeve 3 as well as to the conductive electrode 7.

Particularly, since pre-charging is possible on the upstream side of the non-magnetic sleeve 3, satisfactory charging is obtainable even with reduced diameters of the the photo-sensitive drum 1 and the non-magnetic sleeve 3.

Where the electrode 7 is functioning as a floating electrode, no electric wiring is necessary, and thus it is possible to simplify the structure and wiring layout.

The electrode 7 may be made of a non-magnetic material. Suitably, however, it is made of a magnetic material. Suitably, the magnetic material is disposed such that it faces one or more magnets disposed on the back side of the photo-sensitive member 1. In this case, the magnetic particles 4 can be held magnetically between the electrode 7 and the poles $B_1$ and $B_2$on the back side of the photo-sensitive drum 1.

Further, it is suitable to dispose the electrode 7 of the magnetic material as noted above in the horizontal magnetic field 4B set up between the poles $B_1$ and $B_2$. In this case, the electrode is found in a place where magnetic particles are retained densely, thus permitting charging in a broad area zone.

According to the invention, it is an essential structure that the opposed and adjacent poles $B_1$ and $B_2$ are disposed on the back side of the photo-sensitive drum 1. This means that, as shown in FIG. 13(B), a potential difference is formed such that it falls at the boundary 10C between the charging and non-charging zones 10A and 10B on the photo-sensitive drum 1, which corresponds to the axial end of the opposed and adjacent poles $B_1$ and $B_2$. In this locality, therefore, a particle leakage phenomenon commonly called particle pull-out takes place in the direction of movement of the photo-sensitive drum 1 to have adverse effects on the subsequent exposure, development, etc., as shown in FIG. 13(C).

To overcome this drawback, a blade may be provided on the downstream side in the direction of movement of the photo-sensitive drum 1 to recover the magnetic particles. In this case, however, a mechanism for recovering magnetic particles attached to the blade is necessary for long use, and it complicates the structure.

According to the invention, as shown in FIGS. 8A and 8B, a magnet (or axial end shield pole) $A_2'$ which is of the same polarity as the opposed pole B1, is disposed downstream the opposed pole $B_1$ in the direction of movement of the photo-sensitive drum 1 such that it substantially faces the magnet of the pole $B_1$ via the drum 1.

In this arrangement, a repelling magnetic field is produced between the two like polarity poles to prevent the leakage (or pull-out) of magnetic particles at each axial end of the charging zone and retain the particles therein.

The pull-out of magnetic particles takes place at the boundary between the charging and non-charging zones 10A and 10B, and thus the axial end shield pole $A_2'$, i.e., the second magnet, is suitably disposed such that its end in the axial direction of the photo-sensitive drum 1 is found slightly outward with respect to the end of the opposed pole $B_1$.

With the axial end shield pole $A_2'$ provided substantially over the entire axial dimension or length of the photo-sensitive drum 1 so that its outer end is found slightly outward of the outer end of the opposed pole $B_1$, it is possible to prevent leakage of magnetic particles to the downstream side of the drum 1 and retain the particles in the charging zone over the entire length of the drum 1. Thus, it is possible to effectively prevent the leakage of magnetic particles out of the charging zone without use of any blade or the like, as described above.

The pull-out of magnetic particles is the more pronounced the higher the potential that is formed on the boundary 10C between the charging and non-charging zones 10A and 10B on the photo-sensitive drum 1 at the axial end of the opposed pole $B_1$ on the back side of the drum 1.

According to the invention, the potential difference noted above is made low by setting the charging bias impressed on the magnetic particles 4 to be 400V or below. In addition, as shown in FIGS. 9A to 9C, the main or adjacent pole $A_1$ or $B_2$ is suitably provided at its end with a magnetic member 51 to provide a magnetic edge effect. Alternatively, a repelling pole 52 is provided such that it faces the end of the opposed and adjacent poles $B_1$ and $B_2$. These arrangements have the effect of preventing the pull-out.

It is possible to preclude the pull-out phenomenon at the end of the poles $B_1$ and $B_2$ with arrangements as shown in FIGS. 11A to 12. In these arrangements, the potential difference line that is formed at the boundary 10C between the charging and non-charging zones 10A and 10B on the photo-sensitive drum 1 corresponding to the end 50 of the opposed pole $B_1$ and along the direction of movement of the drum 1, is made to be other than parallel to the direction of movement of the drum 1, and also the potential difference position at the downstream end of the charging zone in the direction of movement of the drum 1 is made to be closer to the axial center of the drum 1 than the potential difference position of the upstream end of the charging zone.

In the specific arrangement as shown in FIG. 11A, the end of the opposed pole $B_1$ is formed that a portion 51 of the end on the downstream side of the charging zone 10B in the direction of rotation of the photo-sensitive drum 1 is slanted or arcuate toward the axial center of the drum 1.

In this case, it is suitable to dispose the main pole $A_1$ on the surface of the photo-sensitive drum 1 facing the opposed pole $B_1$ via the drum 1 and locate the slanted end position of the end of the opposed pole $B_1$ inward of the end of the main pole $A_1$. In this case, magnetic particles that are on the charging zone boundary and directed toward the center can be smoothly attracted to the main pole $A_1$.

Preferably, as shown in FIG. 11B, a magnetic member 57 may be mounted on the end of the opposed pole $B_1$, and also on the end of the adjacent pole $B_2$, if necessary, to form a magnetically closed loop and provide an edge effect.

More preferably, as shown in FIG. 11C, means 53 for capturing magnetic particles flowing along the boundary between the charging and non-charging zones at the end of the photo-sensitive drum 1 in the direction of movement of the drum 1 is provided to lead the magnetic particles flowing along the boundary via it into the charging zone on the axial center side of the drum 1.

Further, the potential difference formed between the charging and non-charging zones on the photo-sensitive drum 1 at the end of the magnet noted above may not fall perpendicularly, but it may be made to fall step-wise or with a slope.

Specifically, as shown in FIG. 12A, a conductor 56 may be provided on and upstream in the direction of rotation of the photo-sensitive drum 1 the boundary 10C between the charging and non-charging zones 10A and 10B. By so doing, a step-wise potential difference line can be formed between the charging and non-charging zones 10A and 10B downstream the conductor 56 in the movement direction thereof. In addition, it is possible to form a substantially inclined potential difference line by appropriately selecting the resistance of the conductor 56.

DETAILED DESCRIPTION OF THE PREFERRED EMBODIMENTS

Now, preferred embodiments of the invention will be described exemplarily in detail with reference to the drawings. It is to be construed that the sizes, materials, shapes, dispositions, etc. of constituent parts described in the embodiments are not limitative but merely exemplary unless particularly noted otherwise.

Figure 7A:
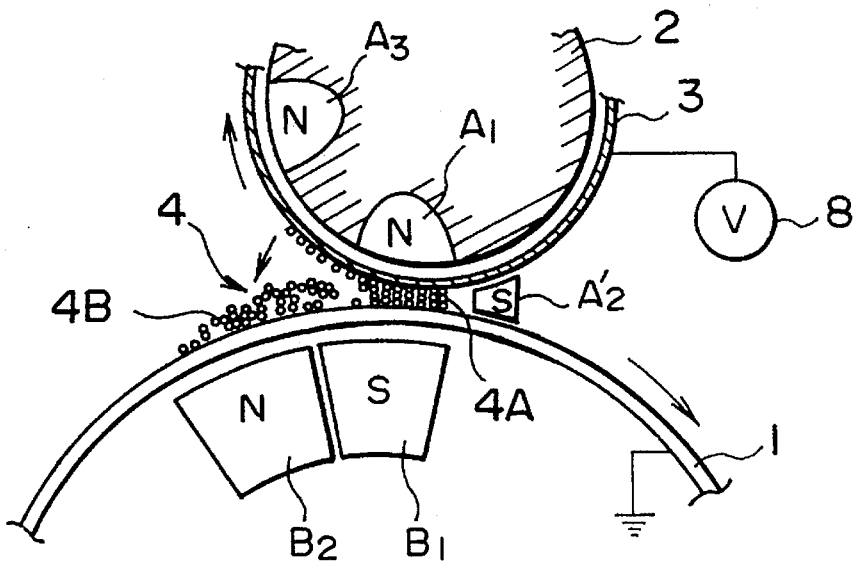
FIGS. 7A and 7B schematically show a first embodiment of the charging apparatus according to the invention, with FIG. 7A being a schematic sectional view showing a shield pole disposed in the gap between a non-magnetic sleeve and a photo-sensitive drum, and FIG. 7B being an enlarged scale view of FIG. 7A.
Figure 7B:
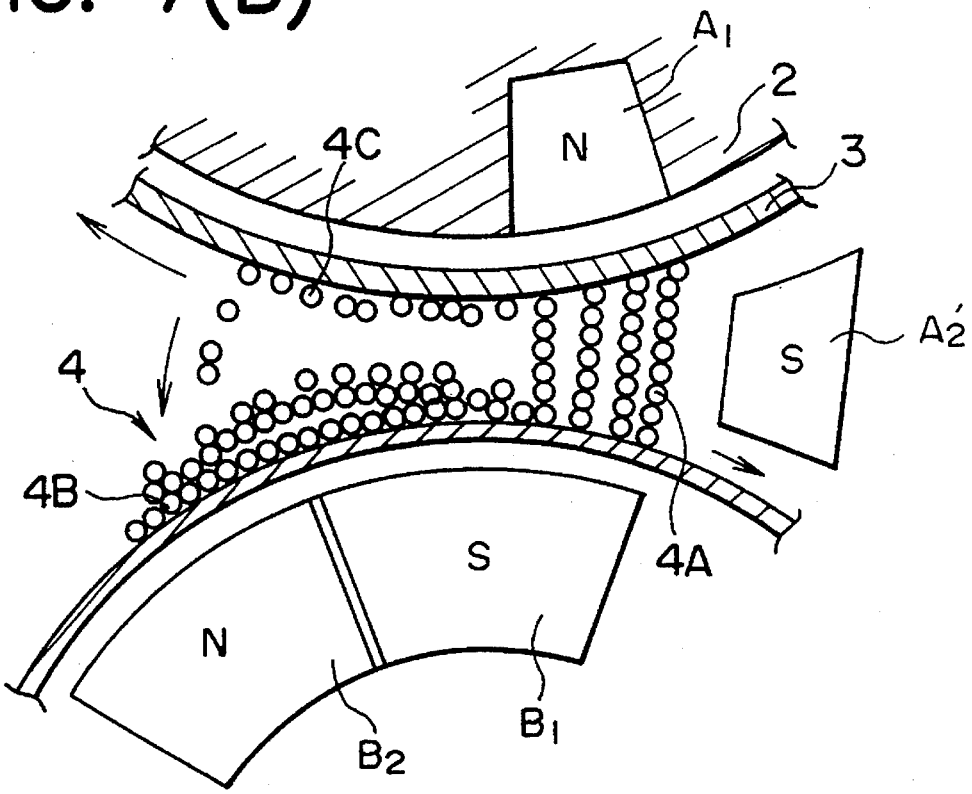

FIG. 7A and 7B show an embodiment of the charging apparatus according to the invention. The apparatus comprises a photo-sensitive drum 1, which is rotated clockwise in the Figure, and a non-magnetic conductive charging sleeve 3, which is disposed such that it faces the drum 1 via a charging gap (of 0.5 mm) and can be rotated in the opposite direction (counterclockwise in the Figure) to the direction of rotation of drum 1. The charging sleeve 3 encloses a stationary magnet assembly 2.

The stationary magnet assembly 2 includes a main pole $A_1$, which is found at a position corresponding to a downstream part of a charging zone in the direction of rotation of the photo-sensitive drum 1, and a shield pole $A_3$, which is disposed in a part of the charging zone upstream the main pole $A_1$ and has the same polarity thereas.

A charging bias is impressed from a bias source 8 via a conductive blade (not shown) or the charging sleeve 3 on conductive magnetic particles 4. Specifically, a DC charging potential of around 150V is provided via the charging sleeve 3.

The conductive magnetic particles 4 which are present in the charging zone are not particularly limited so long as they are electrically conductive. For example, they may comprise a magnetic core of ferrite, iron particles, magnetite, etc. with a conductive resin coating, or they may be blend particles comprising conductive particles and highly resistivity magnetic particles, e.g., blend particles comprising suitable proportions of high resistivity magnetic particles with an average size of about 30 μm and conductive particles with an average size of about 15 μm.

In this embodiment, ferrite core particles are used, which have an average size of 20 to 35 μm, a resistivity of $10^3$ to $10^8$ Ω cm and a magnetic property of 60 to 70 emu/g (1 kOe).

On the back side of the photo-sensitive drum 1, an S polarity opposed pole $B_1$ and an N polarity adjacent pole $B_2$ adjacent to the pole $B_1$ are disposed. The poles $B_1$ and $B_2$ substantially correspond to the main pole $A_1$, which is of N polarity and located in a downstream art of the charging zone.

Thus, the main and opposed poles $A_1$ and $B_1$ facing each other are located in a downstream part of the charging zone in the direction of rotation of the photo-sensitive drum 1. The magnetic particles 4A are thus held by a vertical magnetic field 4A which is set up between the two magnets $A_1$ and $B_1$. Further, since the adjacent pole $B_2$ is disposed adjacent to the opposed pole $B_1$ and upstream the same in the charging zone, the magnetic particles 4B are held in close contact with the photo-sensitive drum 1 by a horizontal magnetic field that is set up mainly between the opposed and N polarity adjacent poles $B_1$ and $B_2$.

Further, in a space between the charging sleeve 3 and the photo-sensitive drum 1 slightly downstream the downstream end of the charging zone in the direction of rotation of the drum 1, a shield pole $A_2'$ having a substantially frust-conical sectional profile having a wedge-like end is disposed such that it faces the main and opposed poles $A_1$ and $B_1$. The shield pole $A_2'$ has the same S polarity as the opposed pole $B_1$.

The frust-conical shield pole $A_2'$ is disposed such that it strides the boundary between a drum area contacted by magnetic particles 4 (charging zone 10A) and an area not contacted thereby (non-charging zone 10B). The magnetic force line density of the shield pole $A_2'$ is set to be higher than the magnetic force line density of the opposed pole $B_1$ on the surface of the photo-sensitive drum 1 and lower than magnetic force line density of the main pole $A_1$ on the surface of the sleeve 3, for instance 600 to 700 Gauss.

As for the magnetic forces of the individual magnets, the magnetic force line densities are set such that the main pole $A_1$ provides a magnetic force of 800 to 1,000 Gauss on the sleeve 3 facing the photo-sensitive drum 1 and that the opposed pole $B_1$ provides a magnetic force of about 300 to 400 Gausss on the surface of the drum 1 over the opposed pole $B_1$. Further, by setting the magnetic force of the adjacent pole $B_2$ to be substantially equal to that of the opposed pole $B_1$, it is possible to obtain a magnetic force of about 300 to 400 Gauss on the surface of the drum 1.

In view of uniform charging and improvement of close contact, the magnetic forces of the opposed and adjacent poles $B_1$ and $B_2$ on the drum surface are suitably as high as possible. However, for smooth movement of magnetic particles in the perpendicular field 4A from the side of the photo-sensitive drum 1 to the side of the non-magnetic sleeve 3, the magnetic forces should be higher on the side of the sleeve 3 compared to the side of the drum 1.

Thus, as the threshold value it is suitable to set the magnetic force line densities of the first opposed pole $B_1$ and the horizontal magnetic field formation adjacent pole $B_2$ at positions right above the individual magnets on the surface of the photo-sensitive drum 1 to 1,000 Gauss or below and set those of the main pole $A_1$ on the sleeve and of the shield pole $A_2'$ to 1,2000 Gauss or below.

To obtain smooth attraction to the main pole $A_1$ of magnetic particles which are prevented by the repelling magnetic field formed between the first magnet $B_1$ and the shield pole $A_2'$ from being brought out of the charging zone, the magnetic force line density of the shield pole $A_2'$ is suitably higher than the magnetic force line density of the first opposed pole $B_1$ on the surface of the photo-sensitive drum 1.

Figure 3:
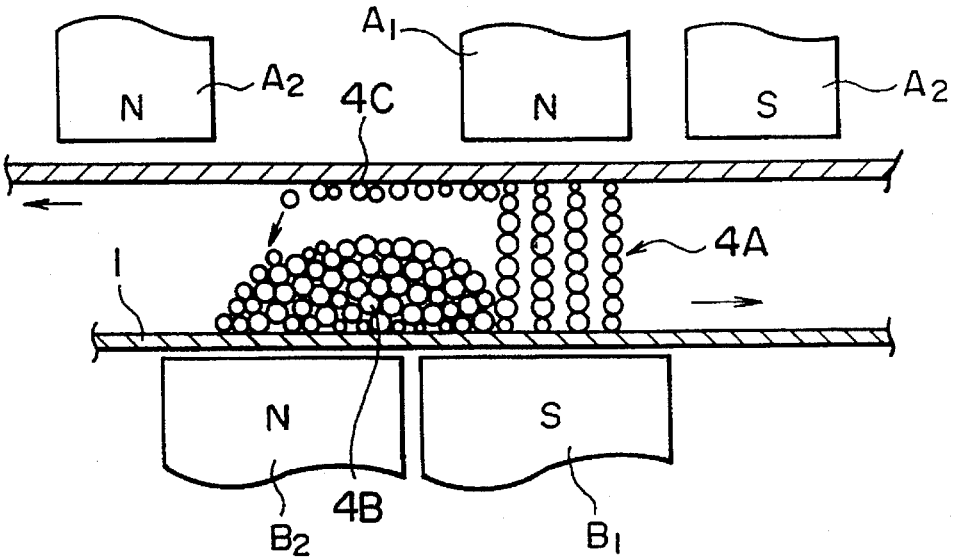
FIG. 3 is a schematic view showing a further basic structure according to the invention, in which, in addition to the structure shown in FIG. 2, a shield pole and a magnetic-force-free zone are provided on the back side of the non-magnetic sleeve.
Figure 4:
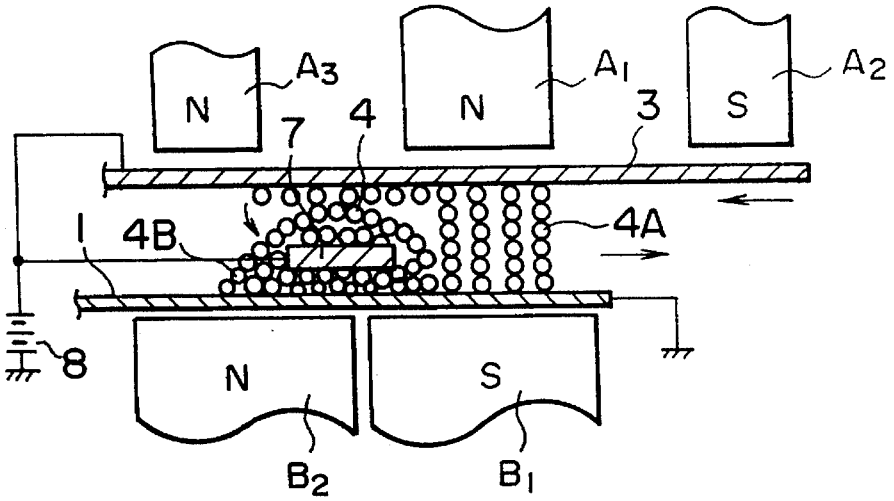
FIG. 4 is a schematic view showing a still further basic structure according to the invention, in which, in addition to the structure shown in FIG. 3, a conductive electrode is disposed within a charging zone.

It is possible to dispose the shield pole $A_2'$ on the back side of the developing sleeve 3, as shown in FIGS. 3 and 4 (see $A_2$).

The magnetic force of the repelling magnet $A_3$ which is of the same N polarity as the main pole $A_1$, is set to be low, i.e., about 50 Gauss or below, in the charging zone upstream the main pole $A_1$.

In view of the uniform charging and close contact, the magnetic forces of the opposed and adjacent poles $B_1$ and $B_2$ on the photo-sensitive drum surface are suitably as high as possible. However, for smooth movement of magnetic particles in the vertical magnetic field 4A from the side of the photo-sensitive drum 1 to the side of the charging sleeve 3, the magnetic force on the side of the sleeve 3 has to be higher than that on the side of the drum 1.

With the embodiment such as above, the magnetic particles 4 that are attached in the charging zone are highly crowded on the photo-sensitive drum 1 in the horizontal magnetic field 4B between the N and S poles $B_1$ and $B_2$, while they are coarse and attached to the drum 1 such as to be erected in the normal direction in the vertical magnetic field 4A on the downstream side of the charging zone other than the horizontal magnetic field 4B.

When the photo-sensitive drum 1 is rotated in this state, the magnetic particles 4, which have smoothly charged the surface of the drum 1 in their crowded state thereon in the horizontal magnetic field 4B, are brought to the position of and magnetically shielded by the vertical magnetic field to be prevented from leaking to the outside of the charging zone. Further, with the magnetic force difference they are attracted from the side of the drum 1 to the side of the sleeve 3 and, with the rotation of the charging sleeve 3 in the opposite direction, are moved toward the upstream side of the charging zone while being carried by the sleeve 3.

When the magnetic particles 4 carried by the charging sleeve 3 reach the magnetic-force-free zone formed by the repelling magnetic field set up by the repelling magnet $A_3$, they are magnetically released and thus fall onto the photo-sensitive drum 1. The above sequence of operations is repeated.

In such embodiment as above, the magnetic particles 4 in the charging zone are circulated at all times even if they are crowded by the horizontal magnetic field. Thus, there is no possibility of deterioration of charging particles even in long use thereof.

This embodiment was assembled in our LED printer ( available under a trade name "Ecosis"), and the state of deterioration of the charging potential on the photo-sensitive drum 1 was checked after producing 20,000 prints. It was found that the charging potential was the same as at the time of the initial stage of printing.

Figure 5:
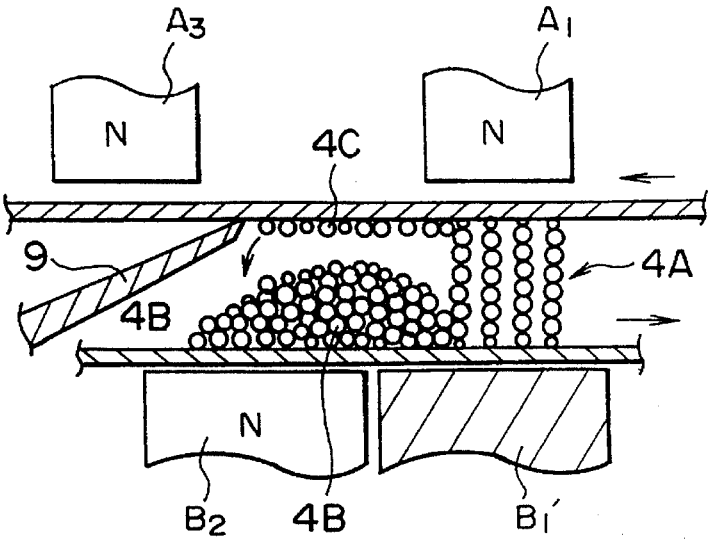
FIG. 5 is a schematic view showing a yet further basic structure according to the invention using mechanical magnetic particle circulation means.
Figure 6:
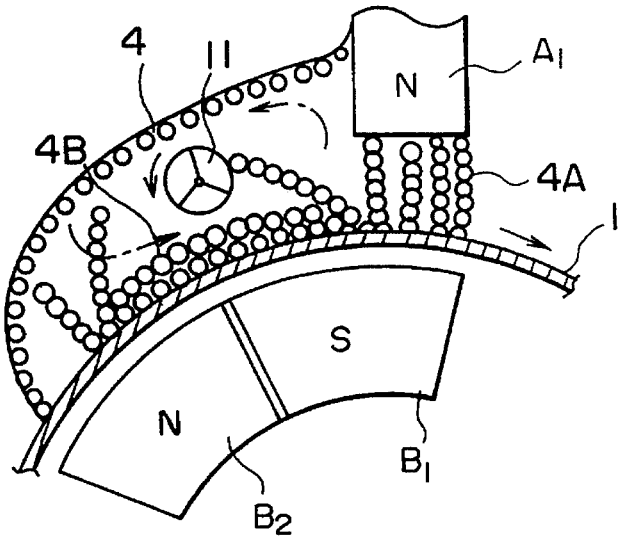
FIG. 6 is a schematic view showing a still another basic structure according to the invention using mechanical magnetic particle stirring means.

FIG. 5 shows a modification of the above embodiment. In this instance, a magnetic member $B_1'$ of ferrite or like material is used in lieu of the opposed pole, and particle separation means 9 such as a blade or a film is disposed near the upstream end of the charging zone, whereby magnetic particles 4C having been carried on the sleeve 3 by the vertical magnetic field 4A to the upstream side of the charging zone are allowed to fall onto the photo-sensitive drum 1.

Figure 1:
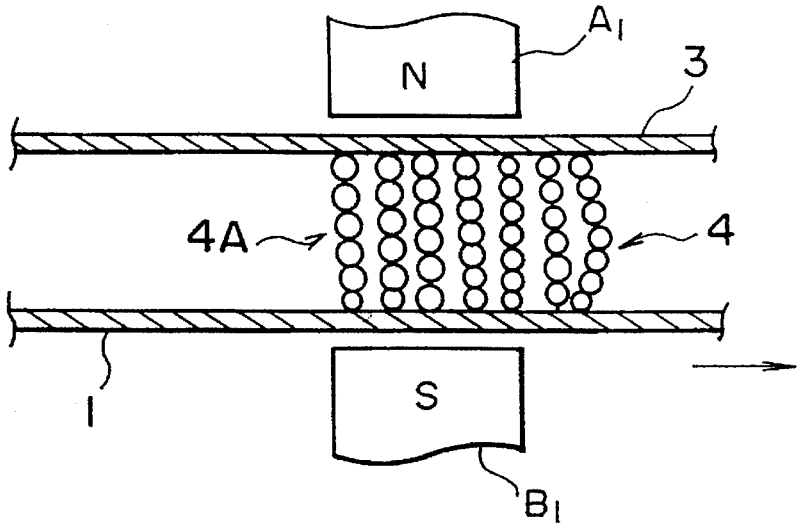
FIG. 1 is a schematic view showing a basic structure according to the invention with a main pole disposed on the back side of a non-magnetic sleeve and an opposed pole disposed on the back side of a photo-sensitive drum.
Figure 2:
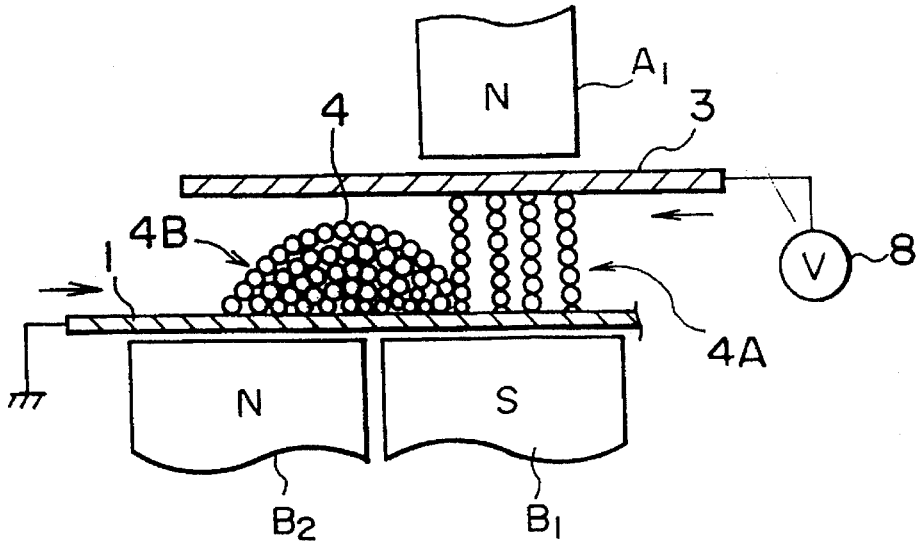
FIG. 2 is a schematic view showing another basic structure according to the invention with a main pole disposed on the back side of a non-magnetic sleeve and an opposed pole and an adjacent pole disposed on the back side of a photo-sensitive drum.

Meanwhile, at the end of each pole the layout structure as shown in FIG. 1 is suitably adopted.

Specifically, the main pole $A_1$, the first magnet $B_1$ and the N polarity magnet $B_2$ are aligned along a vertical line. When a DC charging potential of about 150V is impressed via the charging sleeve 3, the charging potential at the end of the photo-sensitive drum 1, as shown in FIG. 13B, is $V_o$ corresponding to the above charging potential in an area contacted by magnetic particles 4 (charging zone 10A) and 0V in an area not contacted by magnetic particles 4 (non-charging zone 10B).

Figure 8A:
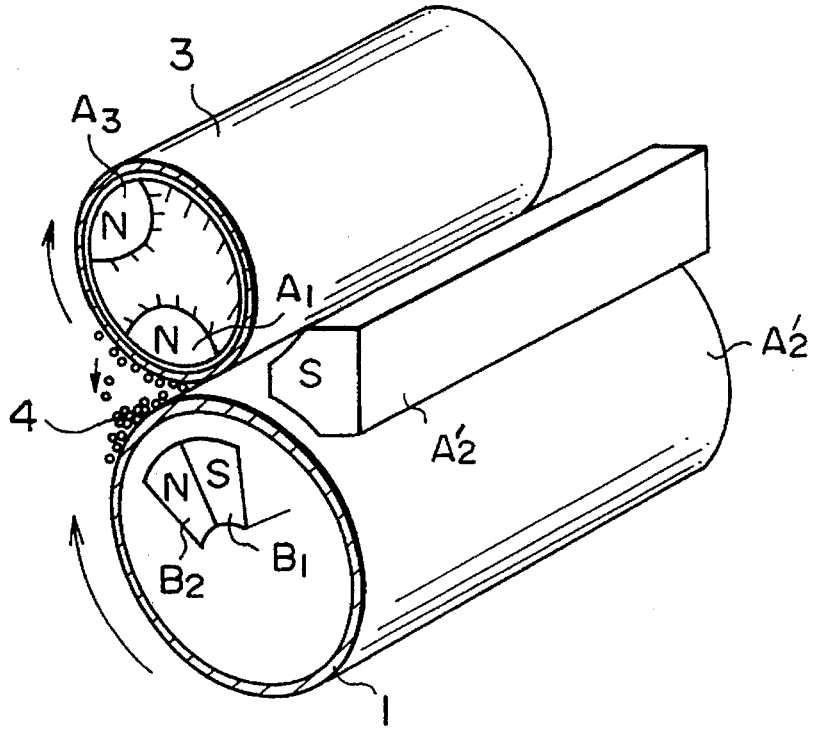
FIGS. 8A and 8B schematically show the layout at an end of the photo-sensitive drum, with FIG. 8A being a perspective view, and FIG. 8B being a plan view.
Figure 8B:
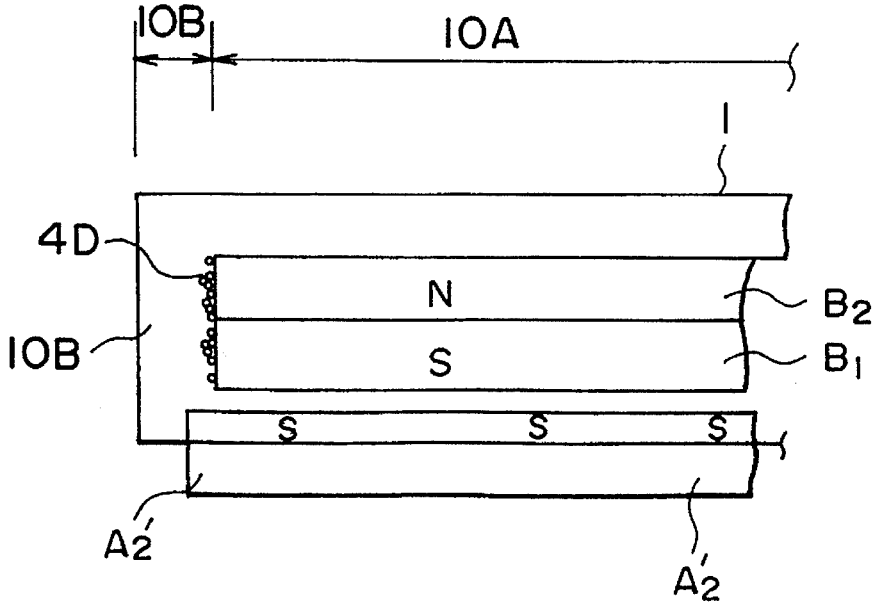
Figure 13A:
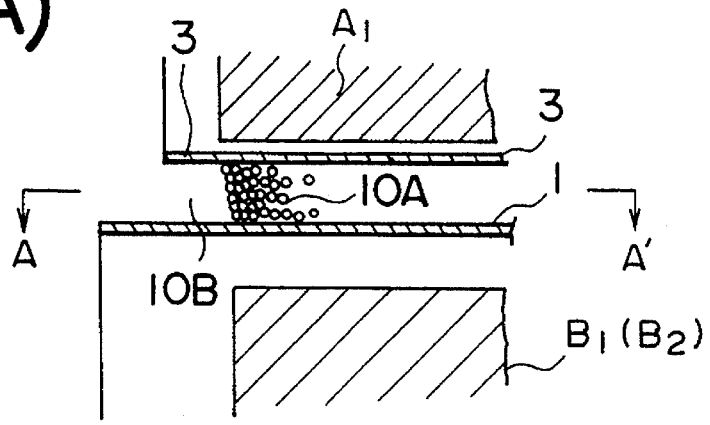
FIGS. 13A to 13C are schematic views showing a comparative example of the charging apparatus, with FIG. 13A being a sectional view showing an end of the apparatus, FIG. 13B being a sectional view taken along line A—A, and FIG. 11C being a graph showing the charging potential in the apparatus.
Figure 13B:
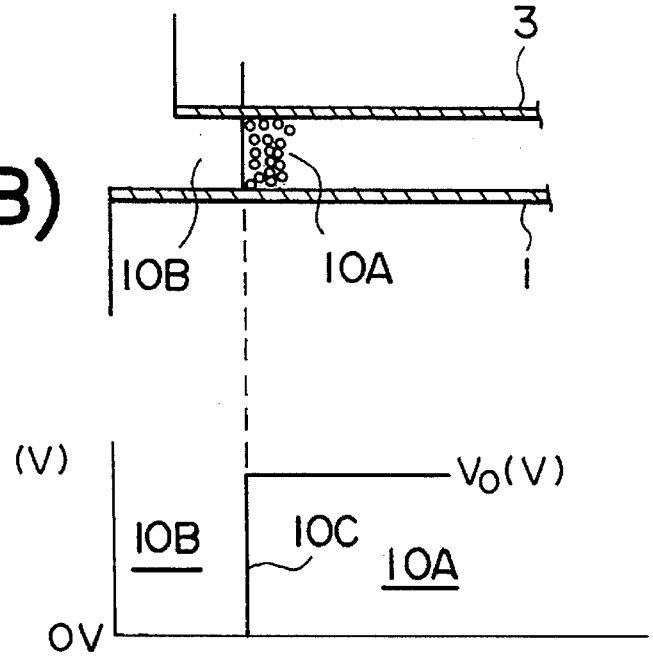
Figure 13C:
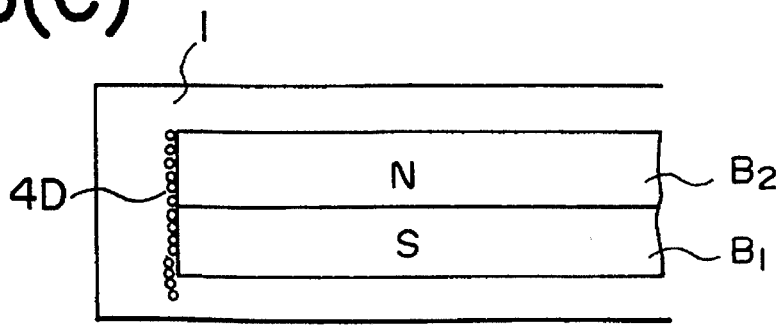

When the photo-sensitive drum 1 is rotated in this state in the direction of arrow, as shown in FIG. 13C, pull-out of magnetic particles takes place due to the potential difference ($V_o$–0) at the boundary between the charging and non-charging zones 10A and 10B. In this embodiment, as shown in FIG. 8B, with the repelling magnetic field set up by the shield pole $A_2'$ at the downstream end, the magnetic particles are not carried to the downstream side of the charging zone but are allowed to escape in the vertical direction by the vertical magnetic field 4A formed by the main and opposed poles $A_1$ and $B_1$.

The magnetic particles 4 that are directed in the vertical direction are now attached to the sleeve 3 by the forces of attraction between the shield and main poles $A_2'$ and $A_1$. Then, with the rotation of the sleeve 3 they are pulled back to the horizontal magnetic field 4B on the upstream side of the charging zone. The sequence of operations as above is repeated to obtain the circulation of magnetic particles.

Thus, in the embodiment such as above, the magnetic particles 4 do not leak out even at the end from the downstream side of the charging zone, and smooth charging is obtainable.

For the purpose of the prevention of the leakage at the end, the shield pole $A_2'$ may be provided only at each end. Preferably, however, the shield pole $A_2'$ is such that it extends over the entire axial dimension or length of the opposed pole as shown by phantom lines in FIG. 8A and 8B, whereby it is possible to prevent the leakage of magnetic particles 4 to the downstream side of the charging zone over the entire length as noted before.

Figure 10A:
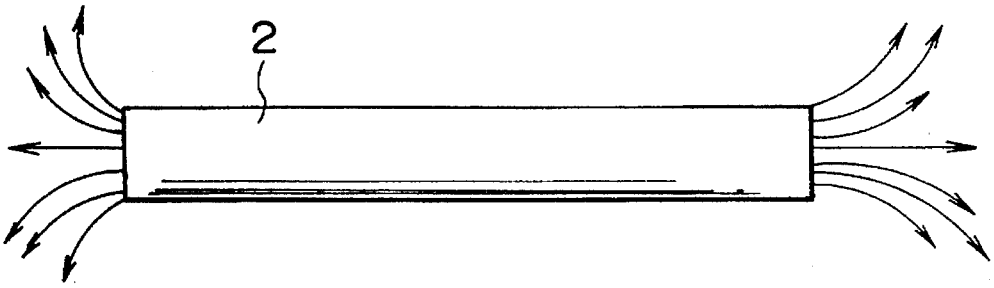
FIG. 10A is a view showing a magnetic force line distribution of the main pole in the prior art.
Figure 10B:
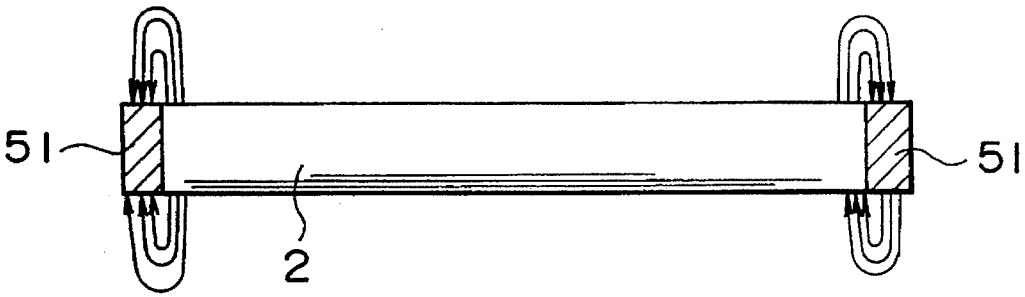
FIG. 10B is a view showing a magnetic force line distribution of the main pole with a magnetic member bonded to the end of the main pole.

With the structure such as the above embodiment, in which the pole $A_2'$ is used to retain the magnetic particles in the charging zone, as shown in FIG. 10A, axially flaring magnetic force lines are formed at the end. Consequently, increased magnetic particles get out along the magnetic force lines.

Figure 9A:
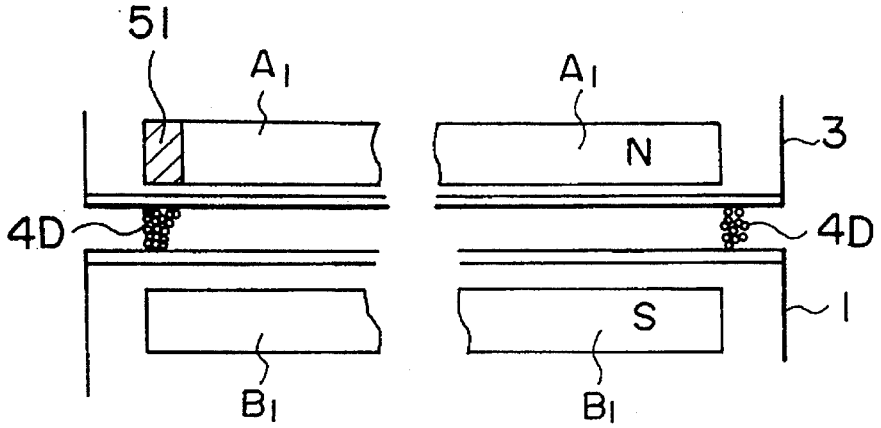
FIGS. 9A to 9C are schematic views showing arrangements for preventing the pull-out of magnetic particles at the end of the photo-sensitive drum, with FIG. 9A showing the magnetic particle distribution between the photo-sensitive drum and the non-magnetic sleeve in case of an arrangement with a magnetic member bonded to a stationary magnet, FIG. 9B showing the magnetic particle distribution in case of an arrangement with a magnetic member bonded to one of a pair of magnets on the back side of the photo-sensitive drum, and FIG. 9C showing the magnetic particle distribution in case of an arrangement with a repelling pole facing a pair of magnets on the back side of the photo-sensitive drum.
Figure 9B:
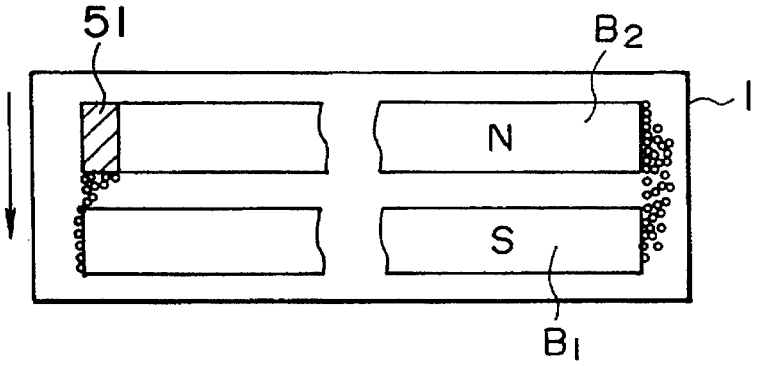

To cope with this difficiency, as shown in FIG. 9A, a thin magnetic member 51 may be bonded to one of the adjacent magnets $B_1$ and $A_1$ of the opposite polarities, in this embodiment the stationary magnet assembly 2 as shown in FIG. 10A, thus forming a closed magnetic loop to provide an edge effect. In this way, it is possible to preclude the above drawback and also reduce magnetic particles getting out of the end of the pole $A_1$ or $B_1$. As an alternative, as shown in FIG. 9B, a thin magnetic member 51 may be bonded to the end of the adjacent pole $B_2$ of N polarity, among the poles $B_1$ and $B_2$ provided adjacent to each other on the back side of the photo-sensitive drum 1, thus forming a closed magnetic loop to provide an edge effect so as to reduce magnetic particles getting out of the end of the adjacent pole $B_2$.

Figure 9C:
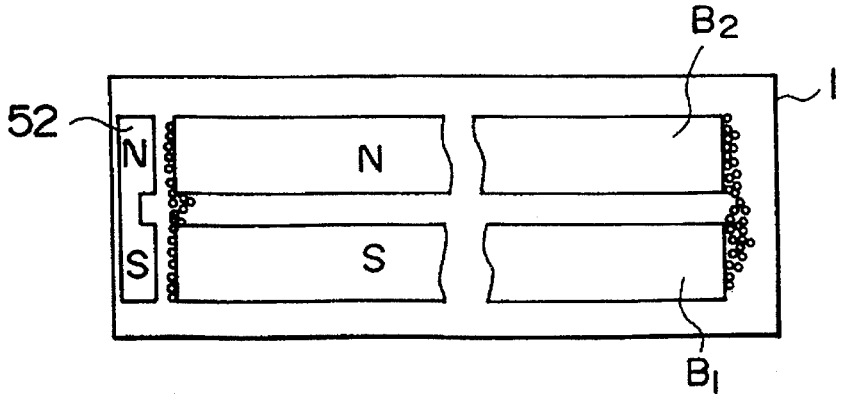

As a further alternative, as shown in FIG. 9C, a repelling pole 52 may be provided such that it faces the end of the opposed and adjacent poles $B_1$ and $B_2$ to obtain the same effects.

The effects noted above are obtainable with the above arrangements in that the cause of the pull-out of magnetic particles is the potential difference ($V_o$–0) noted above at the boundary between the charging and non-charging regions 10A and 10B.

It is thus effective for preventing the pull-out to reduce the potential difference noted above and suppress the spread of magnetic force lines at the end with the magnetic member 51 or repelling pole 52 so as to form a closed magnetic loop or the like.

Figure 11A:
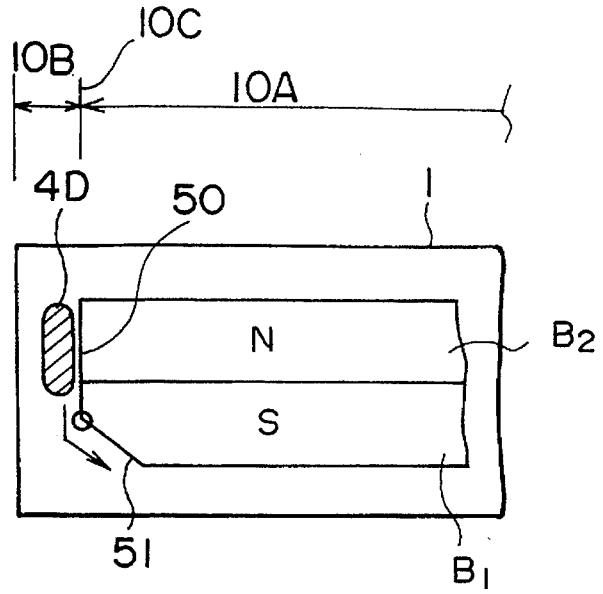
FIGS. 11A to 11C are schematic views showing opposed poles with the end thereof having slanted portions in an embodiment of the invention, with FIG. 11A showing the basic structure, FIG. 11B showing a structure with a magnetic member bonded to the end of the structure shown in FIG. 11A, and FIG. 11C showing a structure using a slanted slit.
Figure 11B:
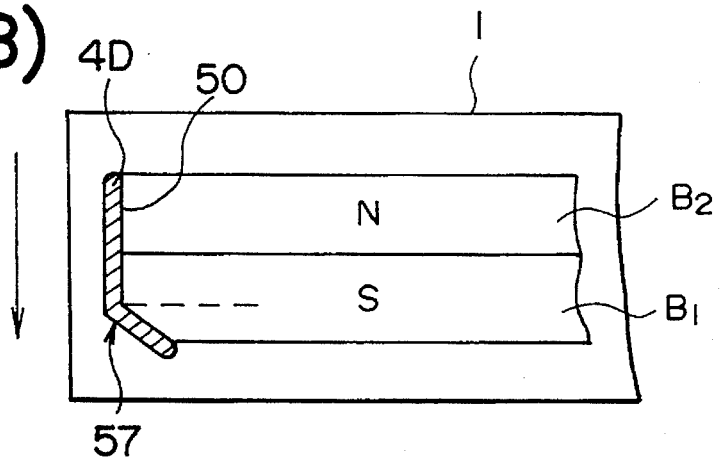
Figure 11C:
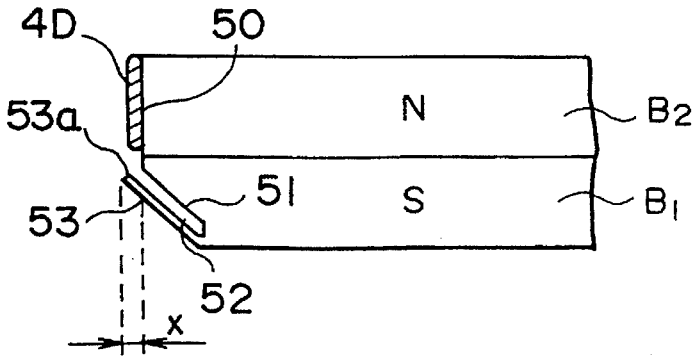

The pull-out of magnetic particles at the end, may further be prevented with the arrangements as shown in FIGS. 11A to 11C.

In the case as shown in FIG. 11A, the end of the opposed pole located on the downstream side of the charging zone 10A is provided with a slanted portion such that the potential difference line formed on the boundary between the charging and non-charging zones 10A and 10B on the photo-sensitive drum 1 in the moving direction thereof is directed toward the axial center of the drum 1 on the downstream side of the charging zone 10A.

Consequently, the magnetic particles 4D that have been pulled out along the end of the adjacent pole $B_2$ on the upstream side of the charging zone 10A, are led toward the opposed pole $B_1$ and then led along the potential difference line into the charging zone 10A on the axial center side. Here, magnetic particles having gotten out of the end of the opposed pole $B_1$ are also led to the axial center side because of mutual magnetic attraction of magnetic particles.

The magnetic particles that have been led to the center side are attracted to the charging sleeve 3 by the main pole $A_1$ on the side of the sleeve 3, and thus they are circulated in the charging zone 10A as noted above.

At this time, since the end of the magnet has the slanted portion 51, its movement speed is low compared to the movement speed of the vertical axis end 50, that is, the kinetic energy of individual magnetic particles is low, and thus the magnet, it attraction can be readily obtained.

In the above embodiment, with a charging potential increase it is liable that the magnetic particles moving along the end of the adjacent pole $B_2$ are not led toward the center side but are pulled out because of an electric field surpassing the magnetic retaining force.

To cope with such a difficiency, as shown in FIG. 11B, a thin magnetic member 57 may be bonded to the end of both the magnets, thus forming a closed magnetic loop to provide an edge effect. It is thus possible to preclude the above drawback and also reduce magnetic particles getting out of the end of the opposed and adjacent poles $B_1$ and $B_2$.

Alternatively, as shown in FIG. 11C, a slanted end portion 51 of the opposed pole $B_1$ may be provided with an extension 53 which extends such as to define a slit 52 and up to a position beyond the end of the adjacent pole $B_2$ by a slight width dimension x.

In this case, even if the charging potential is high, the magnet is particles 4D having been pulled out along the end of the adjacent pole $B_2$ on the upstream side of the charging zone 10A, are led toward the opposed pole $B_1$, whereby the magnetic particles 4D having been led along the end of the adjacent pole $B_2$ can be captured at the free end 53*a* of the extension 53 to be forcibly led along the slit 52 toward the center side.

As noted before, the cause of the pull-out of magnetic particles is the presence of the potential difference ($V_o$–0) at the boundary between the charging and non-charging zones 10A and 10B.

Thus, it is possible to prevent the pull-out if it is possible to reduce the potential difference.

Figure 12A:
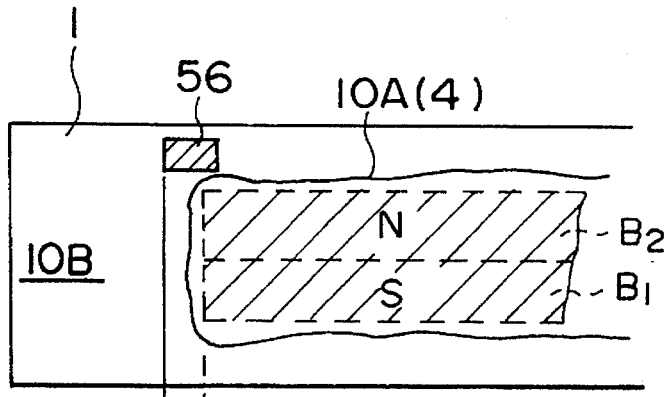
FIG. 12A is a schematic view showing a structure with a conductor provided at the end of a pole on the photo-sensitive drum surface in a different embodiment of the invention.
Figure 12B:
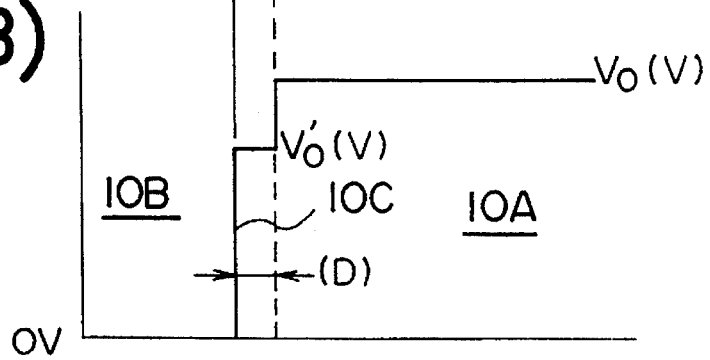
FIG. 12B is a graph showing the charging potential in this embodiment.

FIGS. 12A and 12B show an embodiment which is based on this concept. As shown in FIG. 12A, a conductor 56 in the form of a blade or a brush is disposed on the boundary between the charging and non-charging zones 10A and 10B such that it extends on the upstream side in the direction of rotation of the photo-sensitive drum 1, that is, its end extends into the non-charging zone 10B so that it is in contact with the magnetic particles on the boundary of the charging zone 10A.

With this structure, as shown in FIG. 12B, the potential difference on the boundary of the upstream charging zone 10A in the direction of rotation of the photo-sensitive drum 1, with which the conductor 56 is in contact, i.e., the potential difference between the charging and non-charging zones 10A and 10B, may be formed such that it is stepped in correspondence to the width D of the conductor 56. This has an effect of reducing the potential difference ($V_o$–$V_o'$) on the boundary, and thus it is possible to prevent the pull-out.

In this case, it is possible to permit formation of a potential difference substantially in a slanted fashion by gradually varying the brush fur material of the conductor 56 in the axial direction of the photo-sensitive drum 1, that is, by gradually varying the electric resistance toward the charging and non-charging zones 10A and 10B.

Figure 15:
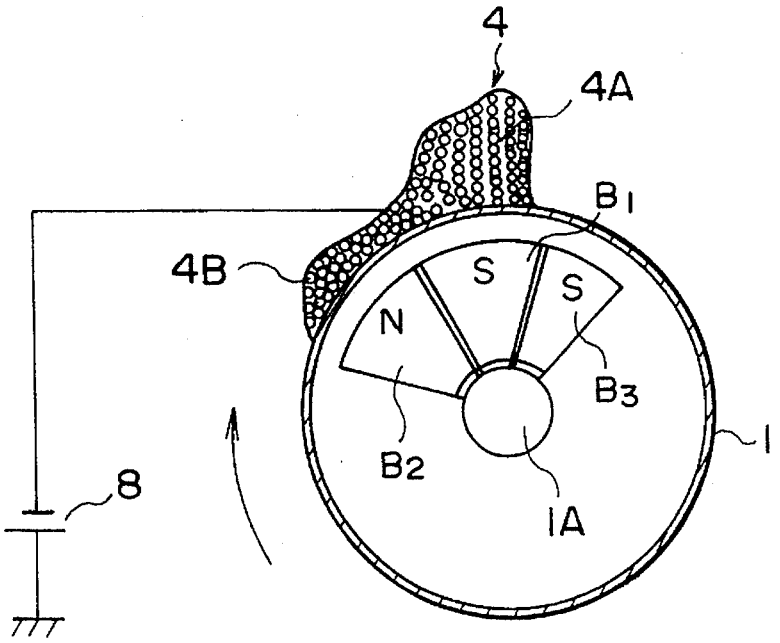
FIG. 15 is a schematic view showing a yet another embodiment of the invention with a magnet provided only on the back side of the photo-sensitive drum.

FIG. 15 shows an embodiment, in which neither stationary magnet assembly 2 nor charging sleeve 3 is disposed on photo-sensitive drum in an opposing fashion, but poles are disposed on the back side of the drum alone.

Specifically, designated at 1 is a photo-sensitive drum rotating clockwise. On the back side of the drum 1, an opposed pole $B_1$ and an adjacent pole $B_1$, respectively, of S and N polarities, are disposed adjacent to each other on the respective downstream and upstream sides such as to substantially uniformly divide the charging zone.

Further, a shield pole $A_2$ of the same S polarity as the opposed pole $B_1$ is disposed at a position adjacent to the opposed pole $B_1$ and slightly downstream the downstream end of the charging zone in the direction of rotation of the photo-sensitive drum 1. A magnetic-force-free zone 4D due to a repelling magnetic field 4C is thus formed between the two poles at the downstream end of the charging zone.

The magnetic forces of the individual magnets are set, when using magnetic particles to be described later, to be 800 Gauss at the pole end on the side of the photo-sensitive drum 1 and 300 to 400 Gauss on the surface of the drum 1 right above the magnet $B_1$.

The conductive magnetic particles 4 which are provided in the charging zone, have the same constitution as in the above embodiment.

Designated at 8 is a bias source for impressing a charging bias to the conductive magnetic particles 4 via a linear electrode.

Figure 16:
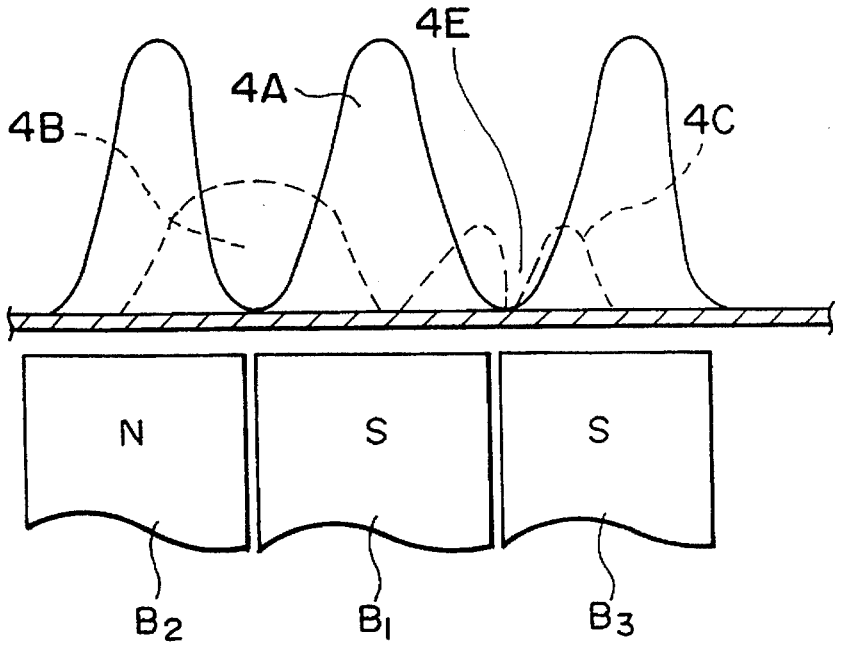
FIG. 16 is a view illustrating the action of magnetic force lines produced in the embodiment shown in FIG. 15.

FIG. 16 shows magnetic actions of the vertical and horizontal magnetic fields 4A and 4B in the above pole layout. It will be seen that a vertical magnetic field 4A is formed at a position right above each pole, a strong horizontal magnetic field 4B is formed between the N and S poles $B_1$ and $B_2$ located in the charging zone, and a repelling magnetic field 4C which is broken into two separate horizontal magnetic fields 4B is formed between the charging zone downstream side pole $B_1$ and repelling pole $A_2$. Consequently, a magnetic-force-free zone 4D is formed between the two poles $B_1$ and $A_1$.

Thus, the magnetic particles 4 in the charging zone are attached densely on the photo-sensitive drum 1 in the hozizontal field 4B between the N and S poles $B_1$ and $B_2$, while they are attached coarsely such that they are erected in the normal direction of the drum 1 in the charging zone downstream side vertical magnetic field 4A other than the horizontal magnetic field 4B.

When the photo-sensitive drum 1 is rotated in this state, the magnetic particles are moved from the horizontal magnetic field 4B into the vertical magnetic field 4A while charging the drum 1. Further, with the magnetic-force-free zone 4D provided by the repelling pole $A_2$, they are not transferred to the downstream side but are directed in the vertical direction by the vertical magnetic field 4A.

The magnetic particles directed in the vertical direction are pulled by the field set up by the first and second poles $B_1$ and $B_2$ back to the horizontal field 4B. The above sequence of operations is repeated to obtain circulation of magnetic particles.

Thus, with the above embodiment smooth charging is obtainable without leak of magnetic particles toward the charging zone downstream slate.

The circulation or interchange of the magnetic particles 4 may be obtained by using electromagnetic poles as the opposed and adjacent poles $B_1$ and $B_2$ and suitably causing, for non-printing time or for every predetermining number of prints, a polarity change or an impressed voltage change, by utilizing a voltage changer 12 of the DC power supply 13 of like means, or by further causing the swinging of the opposed or adjacent pole $B_1$ or $B_2$ for a predetermined angle.

Figure 17:
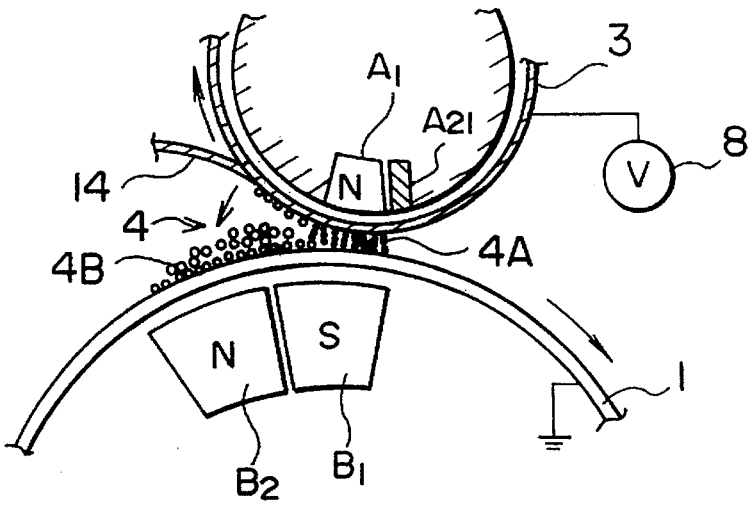
FIG. 17 is a schematic view showing a yet another embodiment of the invention with a magnetic member disposed adjacent to a main pole.
Figure 18:
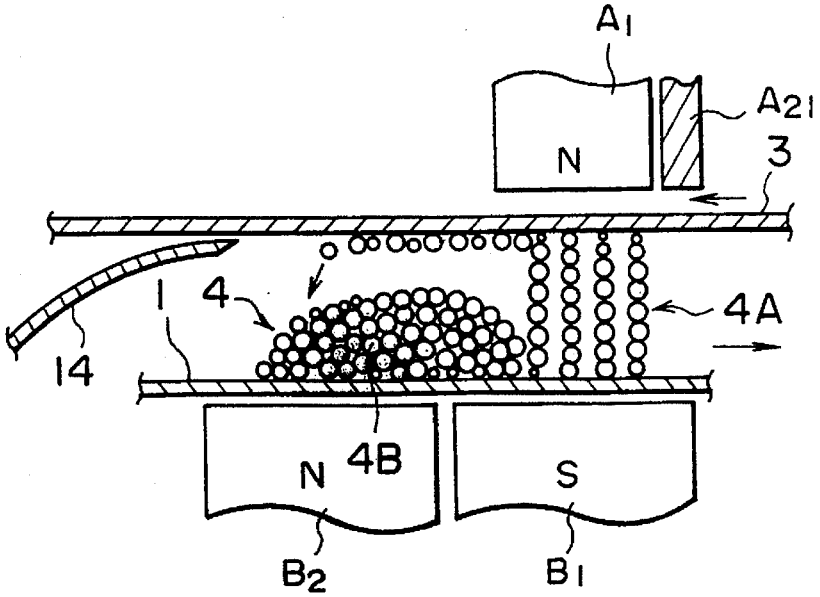
FIG. 18 is an enlarged-scale view showing the embodiment shown in FIG. 17.

FIG. 17 shows a further embodiment of the invention. This embodiment will now be described mainly in connection with its difference from the embodiment shown in FIGS. 7A and 7B. A photo-sensitive drum 1 rotating clockwise in the Figure and a non-magnetic sleeve 3 capable of rotation in the opposite direction (counterclockwise) to the direction of rotation of the drum 1 are disposed with a charging gap (of 0.5 mm) defined between them. A main pole $A_1$ of N polarity is disposed on the back side of the non-magnetic sleeve 3 on the charging zone downstream side such that it faces the opposed pole $B_1$, and a magnetic member $A_{21}$ is disposed on the charging zone downstream side of the main pole $A_1$, whereby a closed magnetic loop of vertical magnetic field 4A is formed.

This embodiment having such a structure as above is the same as the previous first embodiment inasmuch as repeating the operations that the fine magnetic particles 4 which have smoothly charged the surface of the photo-sensitive drum 1 in dense contact therewith in the horizontal magnetic field 4B on the drum 1, are moved with the rotation thereof up to the locality of and magnetically sealed by the vertical magnetic field 4A so that they are prevented from leaking out of the charging zone, while with the magnetic force difference they are attracted from the side of the drum 1 to the side of the sleeve 3 to be carried along, with the rotation of the sleeve 3 in the opposite direction, on the sleeve 3 to the charging zone upstream side and allowed to fall onto the drum 1 with the magnetic force of the horizontal magnetic field 4B. In this instance, however, the magnetic member $A_{21}$ is disposed adjacent to the main pole $A_1$ so that a closed magnetic loop is formed by the vertical magnetic field 4A. Thus, an enhanced magnetic shield effect can be obtained.

In this case, the same function is obtainable by disposing the magnetic member $A_{21}$ adjacent the downstream end of the pole $B_1$ facing the main pole $A_1$ in the direction of rotation of the drum.

Further, to promote the circulation of magnetic particles from the developing sleeve 3, a scraper 14 may be provided, which mechanically separates the magnetic particles and causes these particles to fall into the photo-sensitive drum 1 in the horizontal magnetic field 4B.

Figure 19:
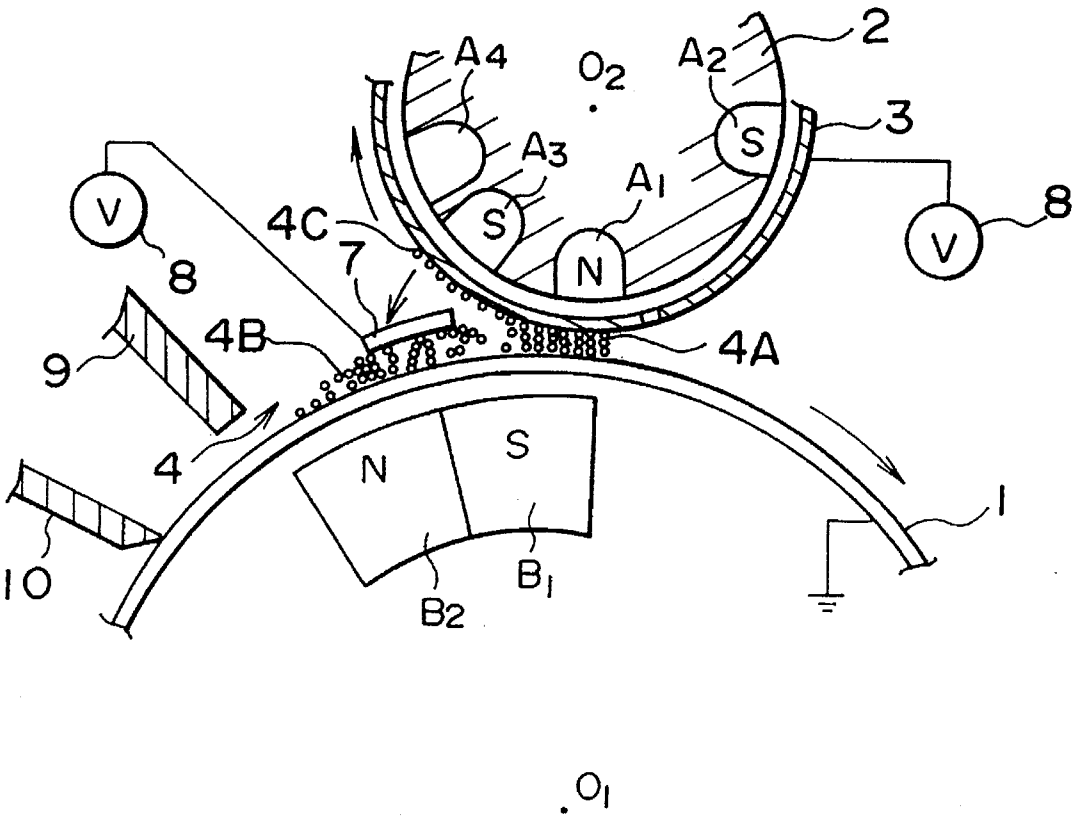
FIG. 19 is a schematic view showing the structure shown in FIG. 4 with a conductive electrode disposed in a charging zone in detail.
Figure 20B:
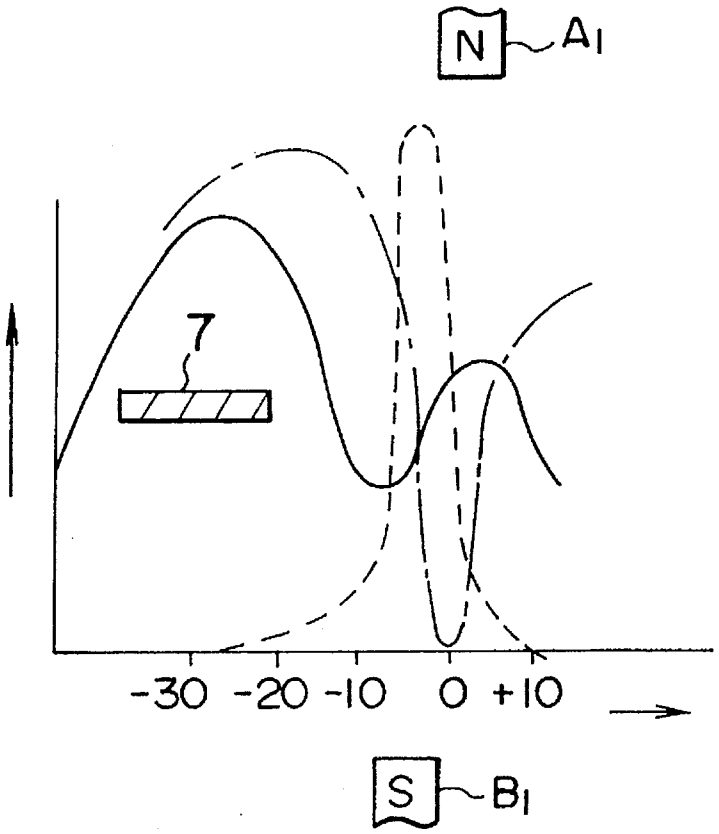
FIG. 20B is a graph showing the distributions in a developed form.
Figure 20A:
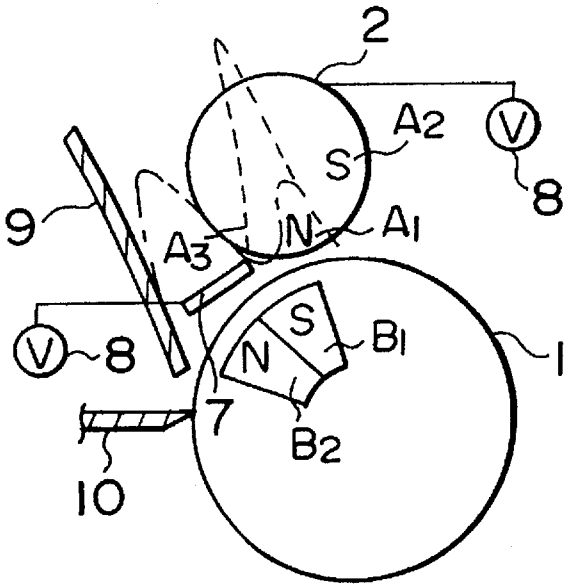
FIG. 20A is a schematic view for describing current distribution and magnetic force distribution when a conductive electrode is provided and when no conductive electrode is provided.
Figure 21:
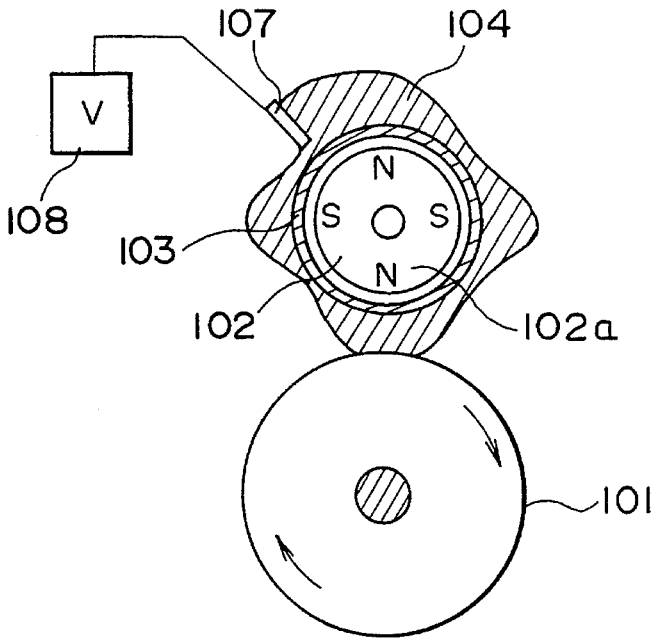
FIG. 21 PRIOR ART
FIG. 21 is a schematic view showing a charging apparatus in the prior art.
Figure 22:
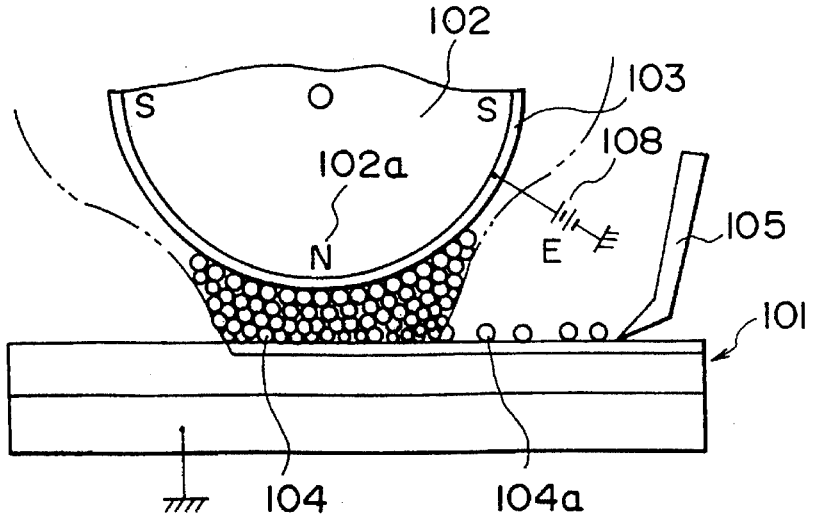
FIG. 22 PRIOR ART
FIG. 22 is an enlarged-scale view showing a structure with a blade scraping off magnetic particles leaking from a charging zone.

FIG. 19 shows a further embodiment of the invention utilizing a conductive electrode. As shown, a photo-sensitive drum 1 which is rotated clockwise in the Figure, and a non-magnetic sleeve 3 which can be rotated in the opposite direction to the drum 1 (i.e., counterclockwise in the Figure, being the same direction of rotation when viewed from the axis of rotation), are disposed such that they face each other via a charging gap 5 (utmost vicinity distance) of about 0.5 mm. Further, on the back side of the sleeve 3, a stationary magnet assembly 2 is disposed on the charging zone downstream side.

The magnet assembly 2 includes poles $A_1$ to $A_2$ and a magnetic-force-free zone $A_4$. The pole $A_1$ is a main pole of N polarity which is disposed on the charging gap 5 or slightly upstream the same in the direction of rotation of the non-magnetic sleeve 3. The pole $A_2$ is a shield pole of S polarity which is disposed upstream the main pole $A_1$ in the direction of rotation of the sleeve 3 and assists magnetic sealing with respect to an opposed pole $B_1$ on the back side of the photo-sensitive drum 1 to be described later. The magnetic-force-free zone $A_4$ is formed on the sleeve 3 downstream the main pole $A_1$ in the direction of rotation of the sleeve 3. This zone $A_4$ is a non-magnetization zone providing as low magnetic force as about 50 Gauss or below. The pole $A_3$ is of S polarity. Whenever magnetic particles 4 carried on the sleeve 3 are brought to the magnetic-force-free zone $A_4$ with the rotation of the sleeve 3 in the opposite direction, they are caused by the pole $A_3$ to fall onto the photo-sensitive drum 1 on the charging zone upstream side.

Instead of providing the magnetic-force-free zone $A_4$, it is possible to provide the poles $A_4$ and $A_3$ as repelling poles.

Conductive magnetic particles 4 are provided in the charging zone between the non-magnetic sleeve 3 and the photo-sensitive drum 1.

As an example of the magnetic particles 4 were used blend magnetic particles comprising conductive and highly resistive magnetic particles with the saturation magnetization in a field of 1 kOe set to 50 emu/g or above, the saturation magnetization in a field of 5 kOe set to 70 emu/g or above and the true specific gravity set to 3 or above. The conductive and highly resistive magnetic particles were blended in a ratio of 20:80. Of the highly resistive magnetic particles, the average size was 39 μm, the distribution of sizes of 20 μm or below was 5% or below, the specific volume resistivity was $1\times10^7$ Ω cm. Of the conductive magnetic particles, the average size was 18 μm, the distribution of sizes of 10 μm or below was 5% or below, and the specific volume resistivity was $1\times10^{-3}$ Ω cm.

On the back side of the photo-sensitive drum 1, in a charging zone downstream part slightly upstream a position opposing the main pole $A_1$ in the direction of rotation of the drum 1, an opposed pole $B_1$ of S polarity is disposed. In addition, adjacent to the opposed pole $B_1$ and in a charging zone upstream part an adjacent pole $B_2$ of N polarity is disposed, which can form a horizontal magnetic field parallel to the surface of the drum 1. A vertical magnetic field which is perpendicular (or normal) to the surface of the drum 1 is formed between the main and opposed poles $A_1$ and $B_1$, and a horizontal magnetic field parallel to the surface of the drum 1 is formed between the opposed and adjacent poles $B_1$ and $B_2$.

Specifically, the main and opposed poles $A_1$ and $B_1$ opposing each other are disposed on the charging zone downstream side in the direction of rotation of the photo-sensitive drum 1 to let magnetic particles 4 be held magnetically by the vertical magnetic field formed between the two poles $A_1$ and $B_1$. The adjacent pole $B_2$ is disposed adjacent to the opposed pole $B_1$ and in a charging zone upstream part to let magnetic particles 4 be in close contact with the photo-sensitive drum 1 by the horizontal magnetic field which is formed on the drum 1 mainly between the two poles $B_2$ and $B_1$.

Designated at 7 is a flat conductive electrode made of a magnetic material, which is disposed in the charging zone on the horizontal magnetic field formed on the photo-sensitive drum 1 between the poles $B_1$ and $B_2$.

Designated at 8 is a bias source which may be a DC power supply, for instance, for impressing a charging bias to the conductive electrode and to the non-magnetic sleeve 3.

Designated at 9 is a housing wall disposed upstream the electrode in the direction of rotation of the photo-sensitive drum 1, and at 10 a cleaning blade.

The operation of this embodiment will now be briefly described. The magnetic particles 4 that are found in the charging zone are closely attached to the photo-sensitive drum 1 in the horizontal magnetic field 4B between the opposed and adjacent poles $B_1$ and $B_2$. The flat conductive electrode 7 is located in the charging zone in this state.

When the photo-sensitive drum 1 is rotated clockwise in this state, the drum 1 is charged while the magnetic particles 4 found in the horizontal magnetic field 4B between the conductive electrode 7 and the two poles located on the back side of the drum 1 are magnetically held.

Subsequently, the magnetic particles are moved toward the charging gap 5, and further charging is done at a position in the vicinity of the charging gap 5 by the charging bias impressed on the non-magnetic sleeve 3. After the surface potential on the photo-sensitive drum 1 has substantially become the saturation potential, the magnetic particles are moved and attracted to the sleeve 3 because the direction of the resultant vector of magnetic force formed between the main and opposed poles $A_1$ and $B_1$ in the charging gap 5 is directed toward the sleeve 3.

At this time, in the charging gap 5 a repelling magnetic field is formed by the shield pole $A_2$ with respect to the opposed pole $B_1$. The repelling magnetic field forms a magnetic-force-free zone on the photo-sensitive drum 1. The magnetic-force-free zone prevents the magnetic particles from being transferred to the downstream side.

The magnetic particles 4B that are attracted to the non-magnetic sleeve 3 are returned to the charging zone upstream side with the rotation of the sleeve 3. Since the magnetic-force-free zone $A_4$ downstream the pole $A_3$ is on the charging zone upstream side, the magnetic particles 4C transferred to the charging zone upstream side are magnetically released to fall onto the photo-sensitive drum 1. The above sequence of operations is repeated to obtain circulation of the magnetic particles 4.

Now, the difference of the current distribution and magneticity distribution in the case when the conductive electrode 7 is provided and the case when the electrode is not provided, will be described with reference to FIGS. 13A to 13C.

In the example shown in FIG. 13A, as the photo-sensitive drum 1 is used an OPC drum with a diameter of 30 mmϕ and a linear speed of 25 m/sec.

As the non-magnetic sleeve 3 is used an aluminum tube with a diameter of 16 mmϕ and a linear speed of 8 m/sec.

As for the magnetic flux densities of the individual poles, the maximum magnetic flux densities of the opposed and adjacent poles $B_1$ and $B_2$ on the photo-sensitive drum 1 are set to S 700 Gauss and N 700 Gauss, respectively, and the maximum magnetic flux densities of the main and shield poles $A_1$ and $A_2$ on the non-magnetic sleeve 2 are set to N 900 or 1,000 Gauss and S 700 Gauss.

The main pole $A_1$ is set to 0°, the opposed pole $B_1$ is set to −5° (the angle being negative in the direction of rotation of the charging sleeve about the maximum magnetic flux density position from the sleeve axis), the adjacent pole $B_2$ is set to −35° and the shield pole $A_2$ is set to 60°. Magnetic force is formed by the main, opposed and shield poles $A_1$, $B_1$ and $A_2$ such that its resultant vector in the normal direction (perpendicular direction to the drum surface) at the most vicinity position P is directed toward the sleeve 3.

This magnetic force distribution is obtained in the charging zone with the peak of magnetic force between the main and opposed poles $A_1$ and $B_1$ set to 0°.

In a comparative example without provision of the conductive electrode 7, in which the charging bias is impressed on the sole non-magnetic sleeve 3, the current distribution has a sharp peak slightly upstream the peak position of the magnetic force between the main and opposed poles $A_1$ and $B_1$.

Thus, it will be seen that in this state the charging is obtained only at a position slightly upstream the charging gap 5 even with magnetic holding of magnetic particles by the poles $A_1$, $B_1$ and $B_2$.

As the current distribution in case of impressing the charging bias on both the sleeve 3 and the conductive electrode 7 that is provided, a current distribution in a form like a twin hill is formed over a wide range over the slightly upstream side of the charging gap 5 and the locality of the electrode.

Thus, in this state it is possible to obtain charging in a wide range substantially corresponding to the entire zone, in which the magnetic particles 4 are held magnetically by the poles $A_1$, $B_1$ and $B_2$.

The actual charging by this charging apparatus was examined by forming images with the apparatus assembled in an LED printer manufactured by our company.

The surface potential on the photo-sensitive drum 1 was checked by forming images with −400V impressed on both the non-magnetic sleeve 3 and electrode 7 from the bias source 8. It was found that very efficient charging could be obtained with a saturation potential before the image formation of −370V and a re-charging potential after the image formation of −340 to −350V.

Then, the surface potential on the photo-sensitive drum 1 was checked by forming images with −400V impressed on the electrode only from the DC bias source 8 to find the saturation potential after the image formation to be −370V and the re-charging potential after the image formation to be −320V. It was possible to maintain a charging level free from generation of a ghost (generation of residual image), although the charging efficiency was slightly reduced.

Figure 14:
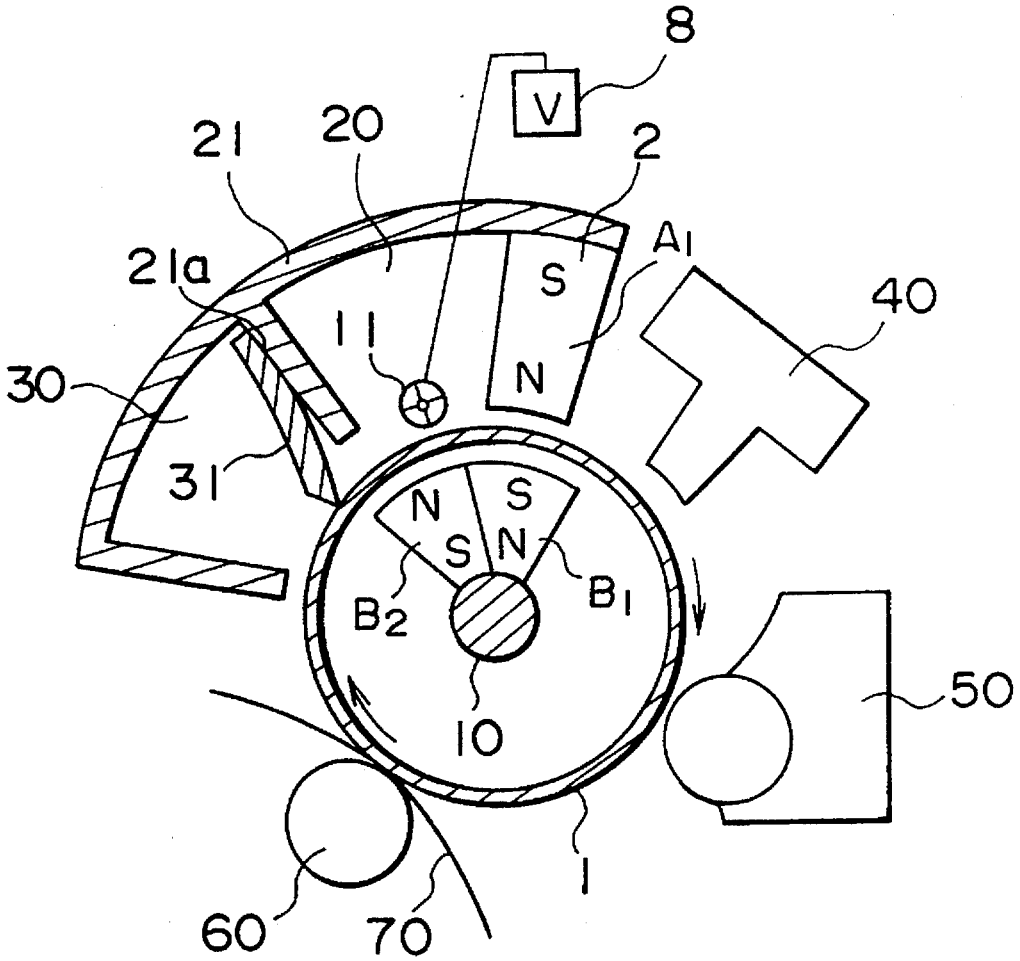
FIG. 14 is a schematic view showing a printer incorporating a further embodiment of the invention, which is a charging apparatus without any non-magnetic sleeve.

FIG. 14 shows a printer incorporating a further embodiment of the charging apparatus without any conductive sleeve according to the invention.

Referring to the Figure, the printer comprises a charging apparatus 20 as the subject matter of the invention, exposure means 40 constituted by an LED unit, a developing unit, 50 constituted by a developing sleeve or the like, a transfer roller 60 and cleaning means 30, these components being disposed around a photo-sensitive drum 1 in the mentioned order in the direction of rotation of the drum 1. After the surface of the drum 1 has been charged uniformly by conductive magnetic particles 4 with a charging bias impressed thereon from the charging apparatus 20, a latent image is formed by the exposure means 40 and then developed by the developing unit 50. The toner image thus formed is then transferred by the transfer roller 60 to a recording sheet 70. The transferred non-fixed is then fixed by a fixing roller (not shown). Meanwhile, residual toner remaining without being transferred by the transfer roller is removed by a cleaning blade 31. The above sequence of operations is repeated.

The charging apparatus 20 and the cleaning blade 31 are integratedly assembled in a sector-like frame 21. The frame 21 is partitioned by a substantially central partitioning frame 21*a*. The cleaning blade 31 forms the cleaning means 30 such that it is disposed in the upstream partitioned space in the direction of rotation of the photo-sensitive drum 1 and mounted on the partitioning wall 21*a*.

The charging apparatus 20 has a bar-like main pole $A_1$ which is directed from the downstream end of the frame 21 in the direction of rotation of the photo-sensitive drum 1 toward the drum 1. In the drum 1, an opposed pole $B_1$ and an adjacent pole $B_2$ adjacent thereto and on the upstream side of the charging zone are disposed such that they substantially face the main pole $A_1$.

A conductive electrode 11 which can be rotated and also serves as a stirring member, is disposed in a space above the photo-sensitive drum 1 between the opposed and adjacent poles $B_1$ and $B_2$. With the rotation of the stirring member, the magnetic particles 4 held in the horizontal magnetic field are interchanged. In this case, the conductive electrode 11 may be rotated at all times or suitably during the charging operation.

In this embodiment, the charging bias source 8 is connected to the conductive electrode 11 only to impress the charging bias on magnetic particles 4 via the electrode 11, it is possible to arrange such that the charging bias is also impressed on the main pole $A_1$ via a conductive film coated thereon.

The magnetic forces of the individual poles are set as in the previous embodiments.

With the embodiment having the above construction, instead of causing circulation of magnetic particles with the conductive sleeve, the conductive electrode 11 can be caused to function as a stirring member for the circulation of the magnetic particles with its rotation, there is no possibility of deterioration even in long use, and like the above embodiments the functions according to the invention are smoothly attainable.

Further, by using a magnetic member in place of the main pole $A_1$ the vertical magnetic field 4A can be similarly formed. In such a case, while the same functions as in the above embodiments are attainable, it is possible to connect the developing bias source 8 to the magnetic member.

What is claimed is:

1. A charging apparatus for charging a photo-sensitive member by magnetically holding magnetic particles in a charging zone and impressing a charging bias on the magnetic particles, the photo-sensitive member having a front side, a back side, and defining a direction of movement, the charging zone defining an upstream side and a downstream side relative to the direction of movement of the photo-sensitive member, the charging apparatus comprising:

magnetic field generation means for generating a magnetic field in the charging zone, the magnetic field generation means comprising:

at least a first magnetic element disposed on the front side of the photo-sensitive member, at least a second magnetic element disposed on the back side of the photo-sensitive member, the first and second magnetic elements being disposed in a substantially mutually opposed relationship and forming a magnetic field in a direction substantially normal to the photo-sensitive member, the photo-sensitive member being charged by the magnetic particles while the magnetic particles are held in the charging zone by the magnetic field.

2. The apparatus of claim 1, wherein the first magnetic element comprises a stationary magnet having a first magnetic pole, and the second magnetic element comprises a stationary magnet having a second magnetic pole opposing the first magnetic pole.

3. The apparatus of claim 1, wherein the first and second magnetic elements are mutually disposed to form a magnetic field on the downstream side of the charging zone.

4. The apparatus of claim 1, comprising at least a third magnetic element disposed on at least one of the front and back sides of the photo-sensitive member on the upstream side of the charging zone substantially adjacent to at least one of the first and second magnetic elements, the third magnetic element forming with at least one of the first and second magnetic elements a magnetic field substantially parallel to the photo-sensitive member.

5. The apparatus of claim 4, wherein the third magnetic element comprises a magnetic pole having a polarity and wherein at least one of the first and second magnetic elements substantially adjacent to the third magnetic element has a magnetic pole having a polarity opposite to the polarity of the magnetic pole of the third magnetic element.

6. A charging apparatus for charging a photo-sensitive member by magnetically holding magnetic particles in a charging zone and impressing a charging bias on the magnetic particles, the photo-sensitive member having a front side, a back side, and defining a direction of movement, the charging zone defining an upstream side and a downstream side relative to the direction of movement of the photo-sensitive member, the charging apparatus comprising:

a substantially non-magnetic sleeve facing the photo-sensitive member, at least a first magnetic element accommodated in the non-magnetic sleeve, and at least a second magnetic element disposed on the back side of the photo-sensitive member, the first and second magnetic elements being disposed in a substantially mutually opposed relationship and forming a magnetic field in a direction substantially normal to the photo-sensitive member on the downstream side of the charging zone, the non-magnetic sleeve being moveable in the charging zone in a direction substantially opposite to the direction of movement of the photo-sensitive member.

7. The apparatus of claim 6, wherein the non-magnetic sleeve defines a surface and the photo-sensitive member defines a surface, the first and second magnetic elements establish a magnetic force on the surface of the non-magnetic sleeve and on the surface of the photo-sensitive member, and wherein the magnetic force on the surface of the non-magnetic sleeve in the magnetic field normal to the photo-sensitive member is greater than the magnetic force on the surface of the photo-sensitive member.

8. The apparatus of claim 6, wherein at least some of the magnetic particles are magnetically sealed in the magnetic field, and further comprising magnetic particle circulating or stirring means for causing the magnetic particles magnetically sealed in the magnetic field to be circulated or stirred in the charging zone.

9. The charging apparatus of claim 8, wherein the circulating or stirring means comprises a magnetically open zone formed on the non-magnetic sleeve on the upstream side of the charging zone.

10. The apparatus of claim 8, wherein at least some of the magnetic particles are carried on the non-magnetic sleeve and wherein the circulating or stirring means comprises separating means for mechanically separating the magnetic particles carried on the non-magnetic sleeve on the upstream side of the charging zone.

11. The apparatus of claim 8, wherein the circulating or stirring means is disposed in the charging zone.

12. A charging apparatus for charging a photo-sensitive member by magnetically holding magnetic particles in a charging zone and impressing a charging bias on the magnetic particles, the charging apparatus comprising:

magnetic field generation means for generating a magnetic field for holding the magnetic particles in the charging zone, wherein the magnetic field generation means comprises: at least a first magnetic element disposed on the front side of the photo-sensitive member, and at least a second magnetic element disposed on the back side of the photo-sensitive member, the first and second magnetic elements being disposed in a substantially mutually opposed relationship and forming a magnetic field in a direction substantially normal to the photo-sensitive member.

13. A charging apparatus for charging a photo-sensitive member by magnetically holding magnetic particles in a charging zone and impressing a charging bias on the magnetic particles, the photo-sensitive member having a front side, a back side, and defining a direction of movement, the charging zone defining an upstream side and a downstream side relative to the direction of movement of the photo-sensitive member, the charging apparatus comprising:

magnetic field generation means for generating a magnetic field for holding the magnetic particles in the charging zone, and a conductive electrode facing the photo-sensitive member on the upstream side of the charging zone, the photo-sensitive member being charged by the magnetic particles while the magnetic particles are held in the charging zone by the magnetic field, wherein the magnetic field generation means comprises: at least a first magnetic element disposed on the front side of the photo-sensitive member, and at least a second magnetic element disposed on the back side of the photo-sensitive member, the first and second magnetic elements being disposed in a substantially mutually opposed relationship and forming a magnetic field in a direction substantially normal to the photo-sensitive member.

14. A charging apparatus for charging a photo-sensitive member by magnetically holding magnetic particles in a charging zone and impressing a charging bias on the magnetic particles, the photo-sensitive member having a front side, a back side, and defining a direction of movement, the charging zone defining an upstream side and a downstream side relative to the direction of movement of the photo-sensitive member, the charging apparatus comprising:

magnetic field generation means for generating a magnetic field for holding the magnetic particles in the charging zone, and a conductive electrode facing the photo-sensitive member on the upstream side of the charging zone, the photo-sensitive member being charged by the magnetic particles while the magnetic particles are held in the charging zone by the magnetic field, comprising: at least two magnetic field generation means disposed on the back side of the photo-sensitive member and substantially adjacent to each other in the direction of movement of the photo-sensitive member, each of the at least two magnetic field generation means comprising at least two magnetic elements having different polarities, the at least two magnetic field generation means forming a magnetic field, the conductive electrode being disposed in the magnetic field formed between the at least two magnetic field generation means.

15. The apparatus of claim 14, wherein the conductive electrode comprises a magnetic element.

16. The apparatus of claim 12, wherein the photo-sensitive member has a front side, a back side, and defines a direction of movement, wherein the charging zone defines an upstream side and a downstream side relative to the direction of movement of the photo-sensitive member, and further comprising:

a conductive electrode facing the photo-sensitive member on the upstream side of the charging zone, and a charging bias source connected to the conductive electrode.

17. A charging apparatus for charging a photo-sensitive member by magnetically holding magnetic particles in a charging zone and impressing a charging bias on the magnetic particles, the photo-sensitive member having a front side, a back side, and defining a direction of movement, the charging zone defining an upstream side and a downstream side relative to the direction of movement of the photo-sensitive member, the charging apparatus comprising:

magnetic field generation means for generating a magnetic field for holding the magnetic particles in the charging zone, and a conductive electrode facing the photo-sensitive member on the upstream side of the charging zone, the photo-sensitive member being charged by the magnetic particles while the magnetic particles are held in the charging zone by the magnetic field, wherein the conductive electrode comprises a floating electrode unconnected to a charging bias source and capable of receiving a charging bias impressed on the magnetic particles via a bias supply member.

18. A charging apparatus for charging a photo-sensitive member by magnetically holding magnetic particles in a charging zone and impressing a charging bias on the magnetic particles, the photo-sensitive member having a front side, a back side, and defining a direction of movement, the charging zone defining an upstream side and a downstream side relative to the direction of movement of the photo-sensitive member, the charging apparatus comprising: at least two magnetic field generation means disposed on the back side of the photo-sensitive member and substantially adjacent to each other in the direction of movement of the photo-sensitive member, each of the at least two magnetic field generation means comprising at least two magnetic elements having different polarities, the at least two magnetic field generation means forming a magnetic field, the photo-sensitive member being charged with the magnetic particles held in close contact with the photo-sensitive member by the magnetic field formed between the at least two magnetic field generation means.

19. The apparatus of claim 18, wherein at least one on the magnetic field generation means comprises a magnetic pole having a polarity, and further comprising a shield pole magnet disposed on the back side of the photo-sensitive member on the downstream side of the charging zone, the shield pole magnet having a polarity identical to the polarity of the magnetic pole.

20. In a charging apparatus having a photo-sensitive member and defining a charging zone, the photo-sensitive member defining a surface, a back side and a direction of movement, the charging zone defining an upstream side and a downstream side relative to the direction of movement of the photo-sensitive member, a method of charging the photo-sensitive member comprising:

providing a plurality of magnetic particles, impressing a charging bias on the magnetic particles, forming a magnetic field in the charging zone on the surface of the photo-sensitive member, and using the magnetic field to hold the magnetic particles in close contact with the photo-sensitive member.

21. The method of claim 20, wherein the step of forming a magnetic field comprises disposing at least two magnetic field generation means on the back side of the photo-sensitive member and substantially adjacent to each other in the direction of movement of the photo-sensitive member, each of the at least two magnetic field generation means comprising at least two magnetic elements having different polarities, the at least two magnetic field generation means forming a magnetic field.

22. The method of claim 20, wherein the step of forming a magnetic field comprises forming a magnetic field in a direction substantially normal to the photo-sensitive member on the downstream side of the charging zone.

23. The method of claim 20, comprising forming a magnetic-force-free zone by a repelling magnetic field on the photo-sensitive member on the downstream side of the charging zone, whereby leakage of magnetic particles from the charging zone is substantially prevented.

24. The method of claim 22, wherein the step of forming a magnetic field in a direction substantially normal to the photo-sensitive member comprises:

providing a non-magnetic sleeve having a surface and accommodating a magnet, moving the non-magnetic sleeve in a direction opposite to the direction of movement of the photo-sensitive member, and establishing a magnetic force on the surface of the non-magnetic sleeve and on the surface of the photo-sensitive member, the magnetic force on the surface of the non-magnetic sleeve in the magnetic field normal to the photo-sensitive member being greater than the magnetic force on the surface of the photo-sensitive member.

25. The method of claim 24, comprising providing at least one of a substantially magnetic-force-free zone on the non-magnetic sleeve and a mechanical separating means for returning to the charging zone those magnetic particles which have moved away from the charging zone along the surface of the non-magnetic sleeve.

26. The method of claim 20, wherein the magnetic particles comprise at least one of conductive magnetic particles and blend magnetic particles comprising conductive magnetic particles and insulating magnetic particles capable of charging bias impression.

27. A charging apparatus for charging a photo-sensitive member by magnetically holding magnetic particles in a charging zone and impressing a charging bias on the magnetic particles, the photo-sensitive member having a surface, a front side, a back side, and defining a direction of movement, the charging zone defining an upstream side and a downstream side relative to the direction of movement of the photo-sensitive member, the charging apparatus comprising:

a magnet having an opposed pole disposed on the back side of the photo-sensitive member and on the downstream side of the charging zone, the opposed pole cooperating with at least one other magnet to magnetically hold the magnetic particles in the charging zone on the surface of the photo-sensitive member, and a magnet having a shield pole of a same polarity as the opposed pole and disposed on the back or front side of the photo-sensitive member on the downstream side of the photo-sensitive member movement direction, the shield pole and the opposed pole forming a repelling magnetic field for magnetically shielding magnetic particles on the downstream side of the charging zone.

28. The apparatus of claim 27, comprising:

a non-magnetic sleeve having a back side, a main pole disposed on the back side of the non-magnetic sleeve and facing the opposed pole, the main pole the opposed pole and the shield pole each defining a magnetic force density, the magnetic force density of the main pole, the opposed pole and the shield pole being set such that:

$S_2>S_2$, $S_2<N_1$, and $N_1>S_1$ where $N_1$ represents the magnetic force density of the main pole on the non-magnetic sleeve, $S_1$ represents the magnetic force density of the opposed pole on the photo-sensitive member, and $S_2$ represents the magnetic force density of the shield pole.

29. The apparatus of claim 27, wherein the shield pole is disposed adjacent to the opposed pole and on the downstream side of the charging zone on the back side of the photo-sensitive drum.

30. The apparatus of claim 27, wherein the shield pole is disposed on the downstream side of the charging zone on the front side of the photo-sensitive member such that the shield pole is in a substantially opposing relationship with the opposed pole and extends in a direction substantially at right angles to the direction of movement of the photo-sensitive member.

31. A charging apparatus for charging a photo-sensitive member by magnetically holding magnetic particles in a charging zone and impressing a charging bias on the magnetic particles, the photo-sensitive member having a surface, a front side, a back side, an axial center and defining a direction of movement, the charging zone defining an upstream side and a downstream side relative to the direction of movement of the photo-sensitive member, the charging apparatus comprising at least one magnet disposed on the back side of the photo-sensitive member, wherein a potential difference line formed on a boundary between charging and non-charging zones on the photo-sensitive member at an end of a magnet extends substantially in the direction of movement of the photo-sensitive member, and wherein the potential difference line at the downstream end of the charging zone is relatively closer to an axial center of the photo-sensitive member than the potential difference line at the upstream end of the charging zone.

32. The apparatus of claim 31, wherein an end of at least one of the magnets located on the downstream side of the charging zone in the direction of movement of the photo-sensitive member is substantially inclined toward an axial center of the photo-sensitive member.

33. The apparatus of claim 31, wherein each of the magnets defines a polarity and wherein at least one of the magnets has an end on which a pole is mounted and the pole defines a polarity which is the same as the polarity of at least one of the magnets.

34. The apparatus of claim 31, comprising a magnetic member mounted on an end of at least one of the magnets for forming a closed magnetic loop.

35. The apparatus of claim 31, comprising a magnet (main pole) of an opposite polarity to that of the opposed pole and disposed on the surface of the photo-sensitive member in opposing relationship with an opposite pole, the opposed pole having a slanted end located on an inner side of an end of the main pole.

36. The apparatus of claim 31, comprising capturing means for capturing magnetic particles flowing along a boundary between charging and non-charging zones at a photo-sensitive member end in a photo-sensitive member movement direction, the capturing means causing magnetic particles flowing along a boundary to be led into a charging zone on a photo-sensitive member axial center side.

37. A charging apparatus for charging a photo-sensitive member via magnetic particles held in a charging zone on a photo-sensitive member surface by one or more magnets disposed on a back side of the photo-sensitive member or by a cooperative action of a magnet or magnets and a further magnet, wherein a potential difference formed between charging and non-charging zones on the photo-sensitive member at an end of a magnet or magnets does not rise perpendicularly but step-wise or with a slope.

38. The apparatus of claim 37, comprising a conductor disposed on a boundary between charging and non-charging zones and at a photo-sensitive member movement direction upstream end, thereby forming a step-wise potential difference between charging and non-charging zones on a photo-sensitive member movement direction downstream side.

39. A charging apparatus for charging a photo-sensitive member via magnetic particles held in a charging zone on a photo-sensitive member surface by one or more magnets disposed on the back side of the photo-sensitive member or by a cooperative action of a magnet or magnets and a further magnet, comprising a further magnet (end shield pole) of a same polarity as that of an opposed pole and disposed at least at an end of a magnet (opposed pole) disposed on the back side of the photo-sensitive member and on a charging zone downstream side such that it substantially opposes a magnet or magnets via the photo-sensitive member.

40. The apparatus of claim 39, wherein the photo-sensitive member axial direction end of an end shield pole is located slightly outward of an end of the opposed pole.

41. The apparatus of claim 40, wherein an end shield pole extends over an entire axial dimension of the photo-sensitive member such that its end is located slightly outward of an end of the opposed pole.

42. The apparatus of claim 39, comprising a main pole disposed on a front side of the photo-sensitive member such that it opposes an opposed pole, and a magnetic member provided on an end of the main pole.

43. A charging apparatus for charging a photo-sensitive member via magnetic particles held in a charging zone on a photo-sensitive member surface by one or more magnets disposed on a back side of the photo-sensitive member or on a back side of a non-magnetic sleeve facing the photo-sensitive member or a cooperative action of a magnet or magnets and a further magnet, wherein a magnetic member is provided on an end of at least one of the magnets that has an opposite polarity, thereby providing a magnetic edge effect, a charging bias impressed on the magnetic particles being set to be 400V or below.

44. A charging apparatus for charging a photo-sensitive member via magnetic particles held in a charging zone on a photo-sensitive member surface by one or more magnets disposed on a back side of the photo-sensitive member or on a back side of a non-magnetic sleeve facing the photo-sensitive member or a cooperative action of a magnet or magnets and a further magnet, wherein a repelling pole is disposed such that it faces an end of at least one of the magnets that is of an opposite polarity, a charging bias impressed on the magnetic particles being set to be 400V or below.

* * * * *